US007798598B2

(12) United States Patent
Horie

(10) Patent No.: US 7,798,598 B2
(45) Date of Patent: Sep. 21, 2010

(54) INKJET RECORDING APPARATUS

(75) Inventor: Kaoru Horie, Hachioji (JP)

(73) Assignee: Olympus Corporation, Tokyo (JP)

( * ) Notice: Subject to any disclaimer, the term of this patent is extended or adjusted under 35 U.S.C. 154(b) by 918 days.

(21) Appl. No.: 11/654,465

(22) Filed: Jan. 17, 2007

(65) Prior Publication Data

US 2007/0165063 A1 Jul. 19, 2007

(30) Foreign Application Priority Data

Jan. 19, 2006 (JP) ..... 2006-011431

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS 6,286,933 B1 * 9/2001 Murakami et al. ..... 347/47
6,761,428 B2 * 7/2004 Agarwal et al. ..... 347/33
6,913,338 B2 * 7/2005 Rhoads et al. ..... 347/28
2001/0002837 A1 * 6/2001 Takahashi et al. ..... 347/19
2002/0126178 A1 * 9/2002 Toh et al. ..... 347/33

FOREIGN PATENT DOCUMENTS

JP 5-42678 A 2/1993
JP 2002-283581 A 10/2002

* cited by examiner

*Primary Examiner*—Stephen D Meier
*Assistant Examiner*—Alexander C Witkowski
(74) *Attorney, Agent, or Firm*—Frishauf, Holtz, Goodman & Chick, P.C.

(57) ABSTRACT

In a cleaning unit that cleans nozzles are provided a support base, a wiping portion that moves together with the support base to clean an ink on the nozzles, and a suction nozzle that is provided on the support base through a spring behind the wiping portion with respect to a traveling direction along which a cleaning operation is performed and sucks the ink subjected to cleaning. The wiping portion is moved by a set pin to adjust a gap between the wiping portion and a recording head, and contact cleaning or non-contact cleaning is selected at the time of cleaning. As a result, there can be provided an inkjet recording apparatus that can prevent an ink-repellant coating from being abraded, stably eject the ink, and record a high-quality image.

17 Claims, 20 Drawing Sheets

INKJET RECORDING APPARATUS

CROSS-REFERENCE TO RELATED APPLICATIONS

This application is based upon and claims the benefit of priority from prior Japanese Patent Application No. 2006-011431, filed Jan. 19, 2006, the entire contents of which are incorporated herein by reference.

BACKGROUND OF THE INVENTION

1. Field of the Invention

The present invention relates to an inkjet recording apparatus having a function of cleaning a nozzle plate provided in a recording head.

2. Description of the Related Art

Recent pervading inkjet printers simply/easily and inexpensively record images at a high speed. An inkjet printer generally carries a recording medium to face a recording head that ejects ink droplets. Then, when the recording medium is facing the recording head, the inkjet printer ejects ink droplets onto the recording medium from the recording head through nozzles. As a result, the inkjet printer records an image on the recording medium.

Nozzles of such an inkjet printer are formed on a nozzle plate. Dust, e.g., foreign particles or extraneous materials, a waste ink and others adhere to such a nozzle plate. When the inkjet printer records an image in a state where such dust or a waste ink has adhered to a part close to the nozzles of the nozzle plate, a discharging direction of ink droplets may change or ink droplets cannot be ejected in some cases. As a result, a quality of an image to be recorded may be possibly lowered. Thus, in the inkjet printer, the nozzle plate is generally conventionally cleaned. As a cleaning method, e.g., a mechanical wiping method and a cleansing method are known. According to the mechanical wiping method, for example, a wiper cleans off dust or a waste ink that has adhered to the nozzle plate, or an ink absorbing member, e.g., a sponge pressed against the nozzle plate sucks and removes dust or a waste ink that has adhered to the nozzle plate. Further, according to the cleansing method, a cap covers the nozzle plate, and discharges a cleaning liquid from the cap side to cleanse the nozzle plate.

However, in the mechanical wiping method, an ink-repellant coating layer (hereinafter, an ink-repellant coating) applied to the nozzle plate may be possibly abraded away to provoke an inconvenience in ink eject. Furthermore, when the nozzle plate is pressed by the wiper or the ink absorbing member, dust or a waste ink may possibly enter the nozzles to provoke clogging of the nozzles.

Moreover, in the cleansing method, a mechanism is complicated. Additionally, when a discharge pressure of the cleaning liquid is set large, the cleaning liquid may enter the recording head through the nozzles to be mixed with an ink.

In order to solve such problems, e.g., Jpn. Pat. Appln. KOKAI Publication No. 042678-1993 discloses a maintenance apparatus 100 for an inkjet printer. FIGS. 36A and 36B show a maintenance apparatus 100. An ink 102 pressurized by a pump (not shown) is supplied to a narrow tube 101 through an ink tube (not shown). A meniscus is formed on the narrow tube 101 by a surface tension of the ink 102. Further, when the pump applies a pressure, the ink 102 is formed into a bridge-like shape in a gap between a nozzle facet 103 of a recording head and the narrow tube 101 due to a capillary force. The ink 102 comes into contact with the nozzle facet 103. When application of a pressure by the pump is stopped in this state, the bridge-like ink 102 maintains the state where it is in contact with the nozzle facet 103, while the narrow tube 101 moves along the nozzle facet 103. As a result, the fine ink that has adhered to the nozzle facet 103 is absorbed into the bridge-like ink 102. When the narrow tube 101 moves away from the nozzle facet 103, the ink 102 is collected into the narrow tube 101, thereby effecting maintenance.

Furthermore, Jpn. Pat. Appln. KOKAI Publication No. 2002-283581 discloses a head wiping apparatus for an inkjet printer. A wiper group having three wipers is provided in this head wiping apparatus. In regard to length dimensions of the wipers, the length increases toward the rear wiper from the front wiper. The front wiper is not in contact with a nozzle plate of a recording head, and the two rear wipers come into contact with the nozzle plate of the recording head to perform cleaning.

BRIEF SUMMARY OF THE INVENTION

To achieve an object, according to the present invention, there is provided an inkjet recording apparatus comprising: a recording head having a nozzle plate on which a nozzle string constituted of a plurality of nozzles that eject an ink onto a recording medium is arranged; and a wiper that cleans a surface of the nozzle plate, wherein one of a first cleaning mode in which the wiper comes into contact with the nozzle plate, and a second cleaning mode in which the wiper is not in contact with the nozzle plate is selected at the time of cleaning, and the wiper relatively moves with respect to the nozzle string to perform the cleaning.

According to the present invention, when the wiper cleans the nozzle plate, one of a contact cleaning mode in which the wiper is brought into contact with the nozzle plate and a non-contact cleaning mode in which the wiper is not in contact with the nozzle plate is selected and executed. According to this structure, an ink-repellant coating applied to the nozzle plate surface can be prevented from being abraded away, and the inkjet recording apparatus that can stably eject an ink and record a high-quality image without provoking clogging for a long time can be provided.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments according to the present invention will now be described in detail hereinafter with reference to the accompanying drawings.

Figure 2:
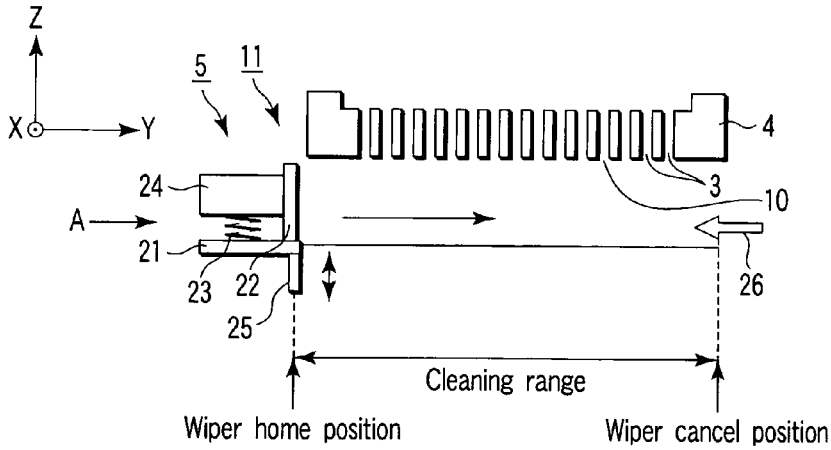
FIG. 2 is a schematic side view of a periphery of a recording head.

In the following explanation, a carrying direction of a recording medium 2 is determined as an X axis direction or a sub-scanning direction, and a direction perpendicular to this carrying direction is determined as a Y axis direction, a main scanning direction, or a width direction of the recording medium 2 in the drawings. A direction perpendicular to the X axis and Y axis directions is determined as a Z axis direction or a vertical direction. Further, as shown in FIG. 2, a position at which a cleaning unit 5 is retracted (stands by) from a recording head 4 is called a wiper home position. A range in which nozzles 3 are cleaned by a wiper 40 is called a cleaning range. A position symmetrical to the wiper home position with the recording head 4 at the center is called a wiper cancel position. Cleaning described in this specification means, e.g., wiping. Further, a height means a height from a support base 21 to each constituent member.

A first embodiment will now be described with reference to FIGS. 1 to 12.

Figure 1:
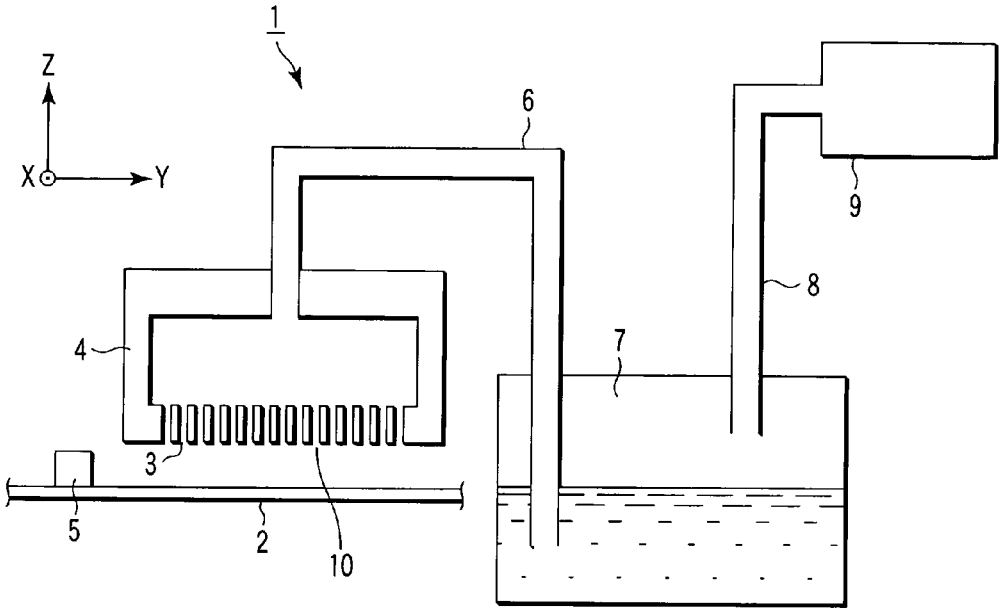
FIG. 1 is a schematic view showing an inkjet recording apparatus of a first embodiment according to the present invention.
Figure 3:
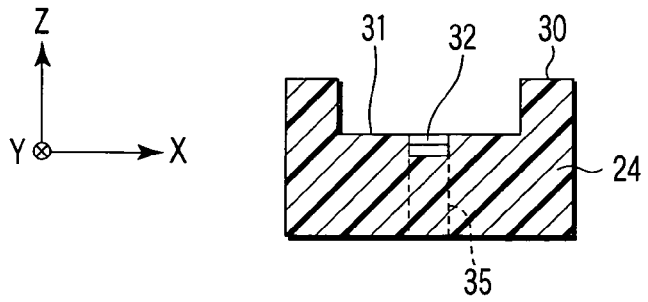
FIG. 3 is a cross-sectional view showing a suction nozzle from a direction A depicted in FIG. 2.
Figure 4:
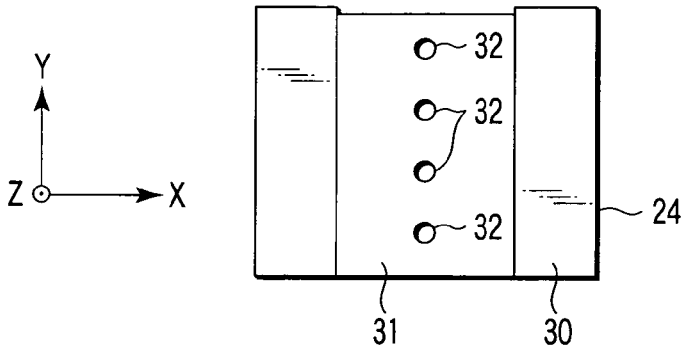
FIG. 4 is a top view of the suction nozzle.
Figure 5:
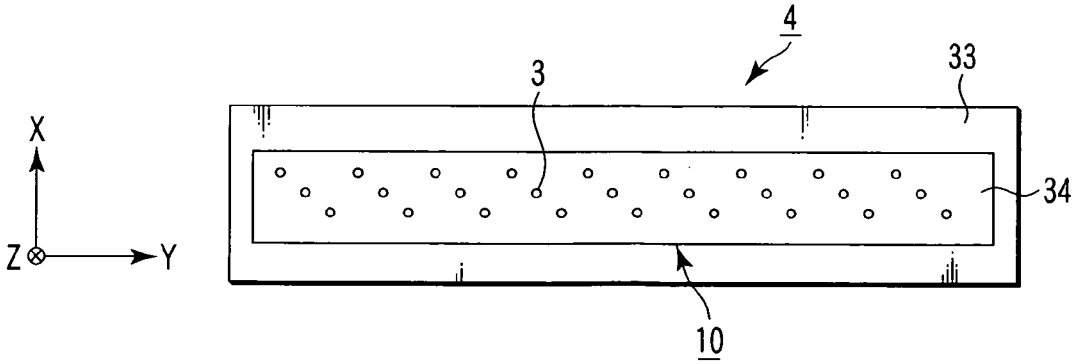
FIG. 5 is a view showing the recording head from a side opposed to the nozzle plate.
Figure 6:
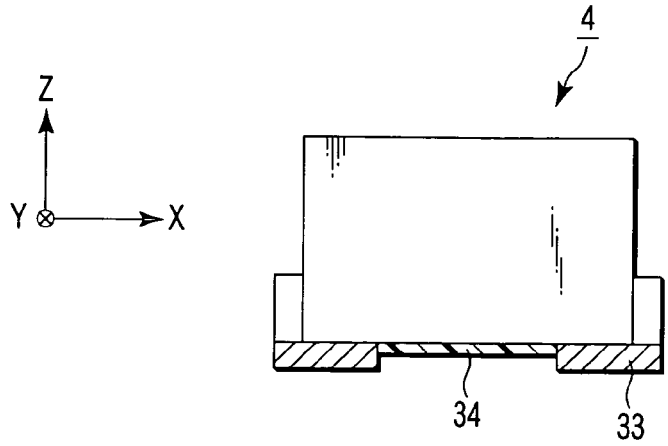
FIG. 6 is a partial cross-sectional view showing the recording head from the direction A depicted in FIG. 2.
Figure 7:
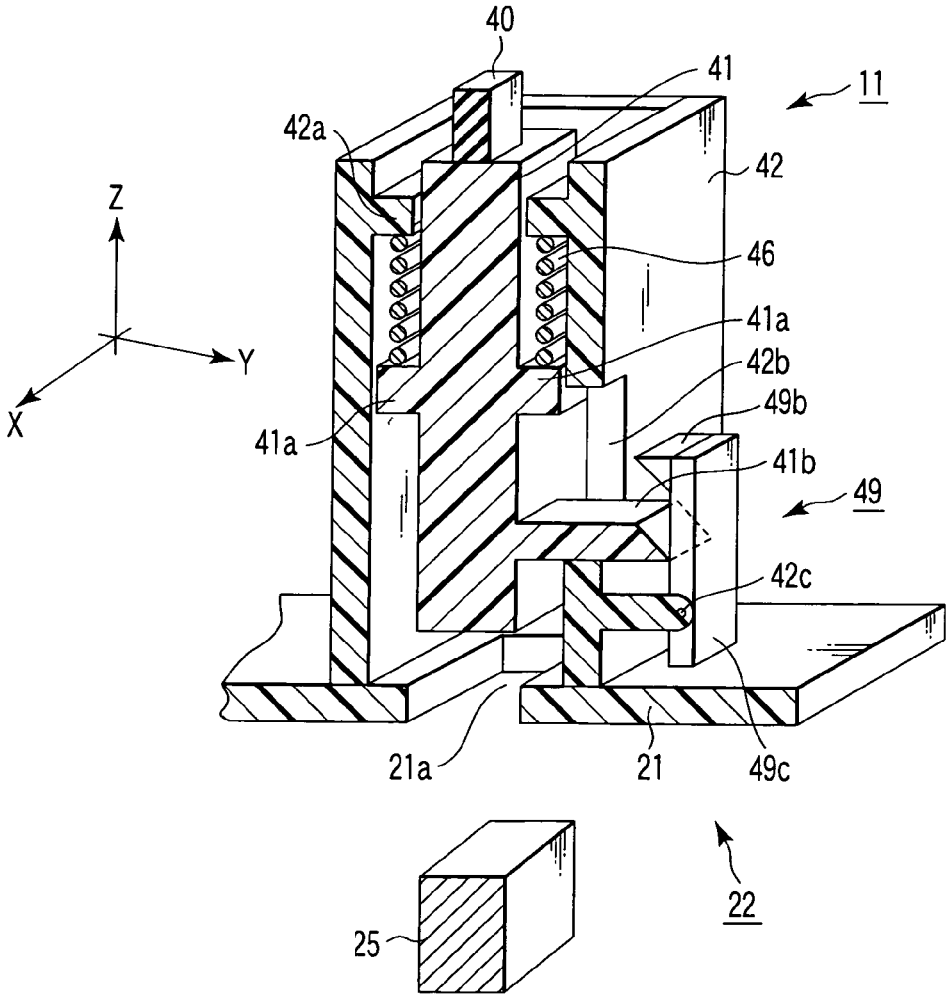
FIG. 7 is a schematic cross-sectional perspective view of a periphery of a wiping portion in a cleaning unit.

FIG. 1 is a schematic view showing an inkjet recording apparatus 1 according to this embodiment. FIG. 2 is a schematic side view of a periphery of a recording head 4. FIG. 3 is a cross-sectional view showing a suction nozzle 24 from a direction A depicted in FIG. 2. FIG. 4 is a top view of the suction nozzle 24. FIG. 5 is a view showing the recording head 4 from a side opposed to a nozzle plate 34. FIG. 6 is a partial cross-sectional view showing the recording head 4 from the direction A depicted in FIG. 2. FIG. 7 is a schematic cross-sectional perspective view of a periphery of a wiping portion 22 in a cleaning unit 5 (the suction nozzle and a spring 23 are omitted).

In the inkjet recording apparatus 1 are provided nozzles 3 that eject an ink onto a recording medium 2, a recording head 4 having the plurality of nozzles 3, a cleaning unit 5 that is provided on a side surface of the recording head 4 and cleans the nozzles 3, a sub-tank 7 that supplies the ink to the recording head 4 through a first ink path 6, and an ink bottle 9 that supplies the ink through a second ink path 8 in order to temporarily fill the sub-tank 7 with the ink. Furthermore, a non-illustrated carriage mechanism is provided to the inkjet recording apparatus 1. This carriage mechanism carries the recording medium 2 that records an image to an X axis direction.

As shown in FIGS. 5 and 6, the recording head 4 has a nozzle plate 34. Nozzle strings 10 constituted of the plurality of nozzles 3 arranged with a predetermined pitch in a Y axis direction are formed on the nozzle plate 34. A mask plate 33 slightly extending to the recording medium side 2 away from the nozzle plate 34 in a Z axis direction is provided to the nozzle plate 34. This mask plate 33 is provided to prevent the nozzle plate 34 from coming into contact with the recording medium 2 or the like to be carried as much as possible.

As shown in FIG. 2, in the cleaning unit 5 are provided a support base 21 that is movable in the Y axis direction (which will be referred to as a traveling direction in which a cleaning operation is performed along the nozzle strings 10 hereinafter), a wiping portion 22 that cleans the ink on the nozzle plate 34, and a suction nozzle 24 that is placed behind the wiping portion 22 with respect to the traveling direction along which the cleaning operation is performed, provided on the support base 21 through the spring 23, and sucks the ink cleaned by the wiping portion 22.

FIGS. 3 and 4 show a structure of the suction nozzle 24. A recess 31 is provided at a central part of an upper surface 30 of the suction nozzle 24. A plurality of suction holes 32 that suck the ink are provided in a line on a bottom surface of this recess 31 at equal intervals in the Y axis direction. The suction holes 32 are connected with an ink suction path 35. The ink filled in the recess 31 is sucked into the ink suction path 35 from the suction holes 32 by a negative pressure generated by a non-illustrated negative pressure generation source. The sucked ink is flowed to a non-illustrated waste liquid bottle through the ink suction path 35. The spring 23 that upwardly urges the suction nozzle 24 is provided below this suction nozzle 24. An urging force of this spring 23 pushes up the suction nozzle 24. At this moment, the upper surface 30 of the suction nozzle 24 comes into contact with the mask plate 33 of the recording head 4. As a result, each portion of the suction nozzle 24 can be prevented from coming into contact with the nozzle plate 34 of the recording head 4.

FIG. 7 shows a structure of the wiping portion 22. In the wiping portion 22 are provided a wiper 40 formed of an elastic member that cleans (wipes) the ink that has adhered to the nozzle plate 34, a wiper support shaft 41 that supports the wiper 40 and is movable in the Z axis direction, and a housing 42 that holds the wiper support shaft 41 to be movable in the Z axis direction. Moreover, a partial mechanism of a gap adjustment mechanism 11 that adjusts a gap between the wiper 40 and the nozzle plate 34 is arranged in the wiping portion 22.

The wiper support shaft 41 is a rectangular shaft-like member extending in the Z axis direction, and holds the wiper 40 on an upper surface thereof. Additionally, a spring engagement portion 41*a* extending from a side surface of this wiper support shaft 41 is formed at a substantially central part of the side surface. It is to be noted that an upper surface of this spring engagement portion 41*a* extends to a position close to an inner surface of the later-described housing 42. Therefore, the spring engagement portion 41*a* has a function of guiding movement of the wiper support shaft 41 in the Z axis direction. Further, an engagement piece 41*b* that restricts a movement range of the wiper support shaft 41 in the Z axis direction with respect to the housing 42 is formed below the spring engagement portion 41*a* in the Z axis direction and on the side surface of the wiper support shaft 41 on the Y axis side. The engagement piece 41*b* pierces an opening portion 42*b* formed in the later-described housing 42. Furthermore, the engagement piece 41*b* protrudes from the opening portion 42*b* so that it can come into contact with a later-explained latch portion 49*b*.

The housing 42 is a hollow shaft-like member. The housing 42 accommodates the wiper support shaft 41 in a hollow part thereof, and surrounds the wiper support shaft 41. The housing 42 holds the wiper support shaft 41 in such a manner that the wiper support shaft 41 can move in the Z axis direction. A spring engagement portion 42*a* extending toward the wiper support shaft 41 is formed on the upper inner surface of the housing 42 in the Z axis direction. This spring engagement portion 42*a* has a function serving as a locking portion of a later-explained spring 46, and a distal end thereof restricts movement of the wiper support shaft 41 in the X axis and the Y axis directions. That is, the spring engagement portions 41*a* and 42*a* move the wiper support shaft 41 along the Z axis direction alone, and also have a function of restricting movement of the wiper support shaft 41 so that this shaft does not oscillate in the X axis and the Y axis directions. Furthermore, an opening portion 42*b* is formed in the side surface of the housing 42 in the Y axis direction. This opening portion 42*b* has a size that allows the engagement piece 41*b* to be inserted therein. A lower edge of the opening portion 42*b* in the Z axis direction comes into contact with the engagement piece 41*b*. The size of the opening portion 42*b* is restricted in such a manner that a position of the wiper support shaft 41 in the Z axis direction with respect to the housing 42 is set to the lowest position at this moment. It is to be noted that an upper edge of the opening portion 42*b* is restricted to be set to a position sufficiently higher than a height position of the later-described latch portion 49*b* in the Z axis direction.

Moreover, a swiveling supporting point 42*c* that supports the swiveling piece 49 on an axis thereof is provided on a side surface of the housing 42 in the Y axis direction. The swiveling piece 49 is supported on the axis of this swiveling supporting point 42*c* to allow its swiveling motion. This swiveling piece 49 is a tabular member, and a latch portion 49*b* is formed at an upper end thereof in the Z axis direction. A cancel operating portion 49*c* with which a cancel pin 26 as a changing member comes into contact is formed at a lower end of the swiveling piece 49 in the Z axis direction. This swiveling piece 49 is urged in a counterclockwise direction by a spring not shown in FIG. 7.

An opening portion 21*a* into which a later-explained set pin 25 can be inserted is formed at a part of the support base 21 corresponding to a part below the wiper support shaft 41.

A spring 46 is interposed between the wiper support shaft 41 and the housing 42. In more detail, the spring 46 is arranged between the spring engagement portion 41*a* and the spring engagement portion 42*a*. An urging force of the spring 46 urges the wiper support shaft 41 downwardly in the Z axis direction. It is to be noted that, when the wiper support shaft 41 is urged downwardly in the Z axis direction, the engagement piece 41*b* comes into contact with the lower edge of the opening portion 42*b*. As a result, a lower end position of the wiper support shaft 41 is specified in the housing 42.

The gap adjustment mechanism 11 also has a set pin 25 as a first adjustment member that adjusts a gap between the wiper 40 and the nozzle plate 34. The set pin 25 is provided at the wiper home position. The set pin 25 moves the wiper 40 toward the recording head 4 along the Z axis direction. In more detail, in a state where the cleaning unit 5 is placed at the wiper home position, the set pin 25 is provided below the opening portion 21*a* formed in the support base 21.

This set pin 25 can move in the Z axis direction by a non-illustrated drive mechanism, and pushes up the wiper support shaft 41 along the Z axis direction through the opening portion 21*a*.

This set pin 25 pushes up and moves up the wiper support shaft 41 along the Z axis direction. When the wiper support shaft 41 moves up, the engagement piece 41*b* moves (moves up) in the opening portion 42*b*. When the engagement piece 41*b* moves up, the engagement piece 41*b* comes into contact with the latch portion 49*b*. At this time, the swiveling piece 49 swivels in the clockwise direction in FIG. 7 against an urging force of a non-illustrated spring functioning on the swiveling piece 49 and, at the same time, the engagement piece 41*b* further moves up. When the engagement piece 41*b* moves up beyond the latch portion 49*b*, the swiveling piece 49 again swivels in the counterclockwise direction by the urging force of the non-illustrated spring. As a result, the latch portion 49*b* is placed below the engagement piece 41*b*. Here, when upward movement of the set pin 25 is stopped and the set pin 25 is then moved down, the wiper support shaft 41 moves down along the Z axis direction by the urging force of the spring 46. At this time, when the engagement piece 41*b* comes into contact with the upper surface of the latch portion 49*b*, the wiper support shaft 41 stops at this position. As a result, the wiper support shaft 41 is placed above the housing 42, and the wiper 40 has the maximum height in the Z axis direction.

Further, a cancel pin 26 (a changing member) that moves the wiper 40 to be retracted from the recording head along the Z axis direction is provided at the wiper cancel position. The cancel pin 26 is included in the gap adjustment mechanism 11. The cancel pin 26 is fixed at a position where it can comes into contact with a cancel operating portion 49*c*. When the cleaning unit 5 moves along the Y axis direction to approach the cancel pin 26, the cancel pin 26 comes into contact with the cancel operating portion 49*c*. As a result, the swiveling piece 49 swivels in the clockwise direction. When the swiveling piece 49 swivels in the clockwise direction, the latch portion 49*b* is retracted from a position below the engagement piece 41*b*. At the same time, the wiper support shaft 41 moves down by the urging force of the spring 46. The wiper support shaft 41 that keeps downward movement moves down until the engagement piece 41*b* comes into contact with the lower edge of the opening portion 42*b*.

Operations in non-contact cleaning (a second cleaning mode) and contact cleaning (a first cleaning mode) and an operation of the wiping portion 22 in each cleaning mode will now be described with reference to FIGS. 8A, 8B, 8C, 8D, 8E, 8F, 9A, 9B, 9C, 9D, 9E, and 9F. It is to be noted that the suction nozzle 24 and the spring 23 are omitted in FIGS. 8A, 8B, 8C, 8D, 8E, and 8F like FIG. 7.

Figure 8C:
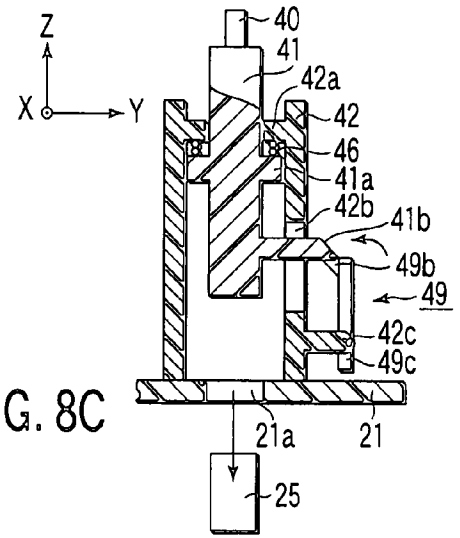
FIG. 8C shows the wiping portion in a state where the engagement piece of the wiper support shaft engages with a latch portion of a swiveling piece and a height of the wiper in a Z axis direction is set at the highest position at the wiper home position.
Figure 8B:
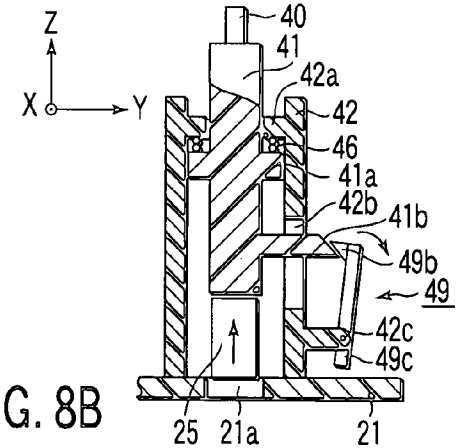
FIG. 8B shows the wiping portion in a state where the wiper support shaft is being moved up by a set pin at the wiper home position.
Figure 8A:
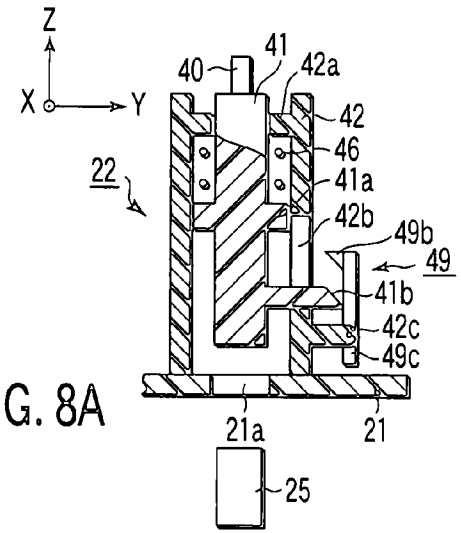
FIG. 8A shows the wiping portion in a state where an engagement piece of a wiper support shaft is placed at a lower edge of an opening portion by an urging force of a spring at a wiper home position.

FIG. 8A shows the wiping portion 22 in a state where the engagement piece 41*b* of the wiper support shaft 41 is placed at the lower edge of the opening portion 42*b* by the urging force of the spring 46 at the wiper home position.

FIG. 8B shows the wiping portion 22 in a state where the wiper support shaft 41 is being moved up by the set pin 25 at the wiper home position.

FIG. 8C shows the wiping portion 22 in a state where the engagement piece 41*b* of the wiper support shaft 41 engages with the latch portion 49*b* of the swiveling piece 49 and the wiper 40 has the maximum length in the Z axis direction at the wiper home position.

Figure 8F:
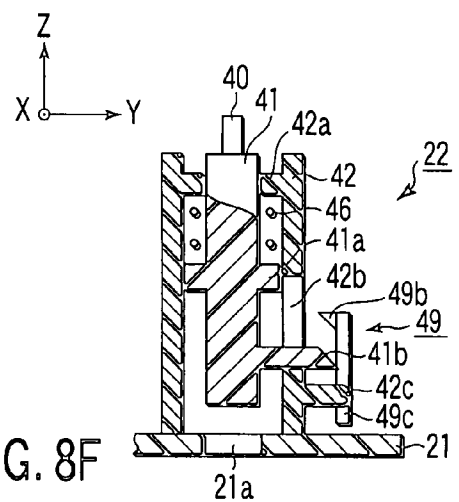
FIG. 8F shows the wiping portion in a state where the engagement piece of the wiper support shaft is placed at the lower edge of the opening portion at the wiper cancel position.
Figure 8E:
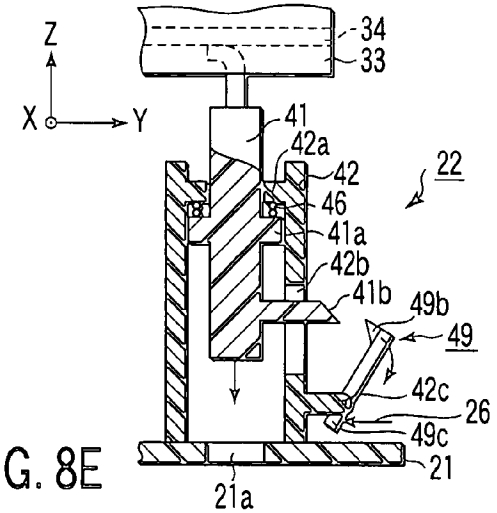
FIG. 8E shows a state where a cancel operating portion of the swiveling piece is in contact with a cancel pin and where the wiper shifts from a contact condition to a non-contact condition with respect to the nozzle plate at a wiper cancel position.
Figure 8D:
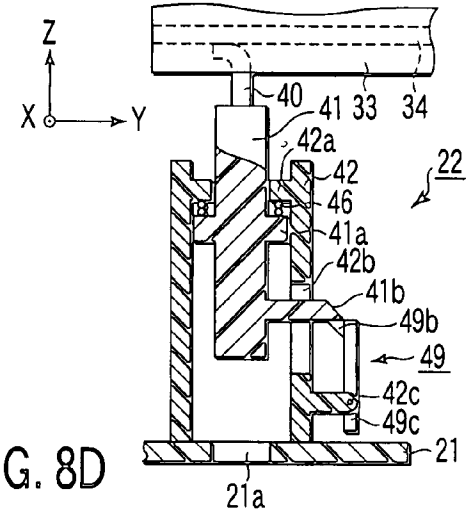
FIG. 8D shows the wiping portion in a state where the wiper is placed at the highest position and performing contact cleaning with respect to a nozzle plate.

FIG. 8D shows the wiping portion 22 in a state where the wiper 40 has the maximum height and performs contact cleaning with respect to the nozzle plate 34.

FIG. 8E shows a state where the cancel operating portion 49*c* of the swiveling piece 49 is in contact with the cancel pin 26 and a state where the wiper 40 shifts from a contact state to a non-contact state with respect to the nozzle plate 34 at the wiper cancel position.

FIG. 8F shows the wiping portion 22 in a state where the engagement piece 41*b* of the wiper support shaft 41 is placed at the lower edge of the opening portion 42*b* in the wiper cancel position.

Figure 9A:
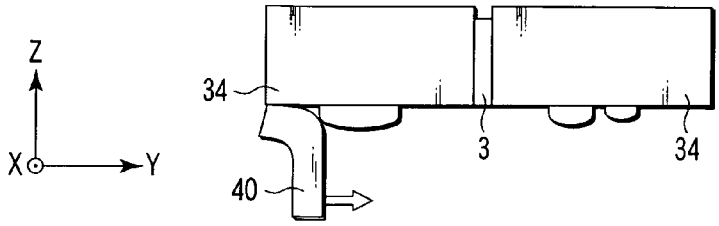
FIG. 9A is a view showing a state where the wiper moves in contact with a nozzle plate surface.
Figure 9B:
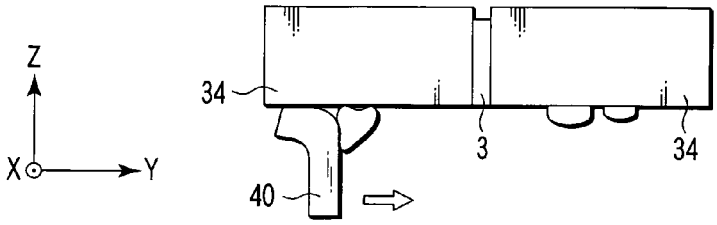
FIG. 9B is a view showing a state where the wiper removes an ink remaining on the nozzle plate surface.
Figure 9C:
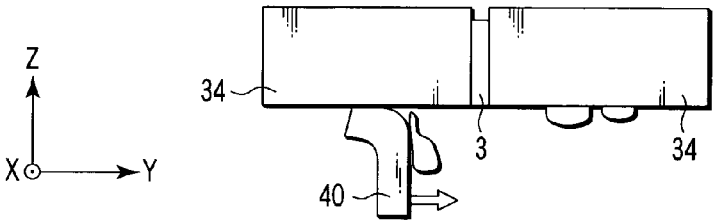
FIG. 9C is a view showing how the wiper removes the ink from the nozzle plate and moves in a Y axis direction.
Figure 9D:
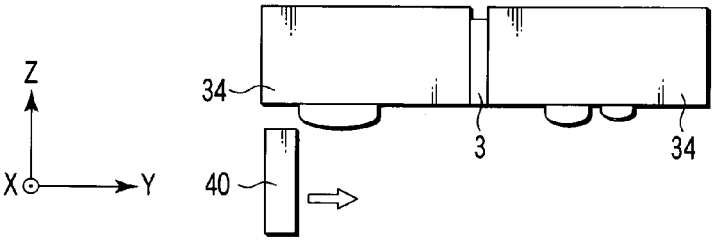
FIG. 9D is a view showing a state where the wiper moves without contacting with the nozzle plate surface.
Figure 9E:
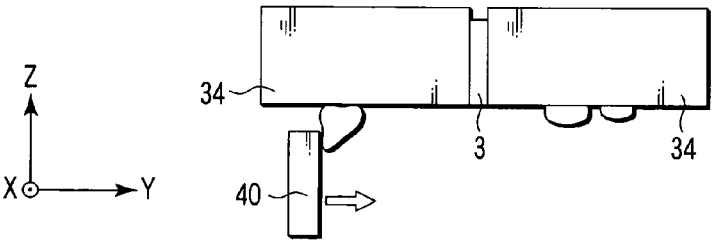
FIG. 9E is a view showing a state where the wiper removes the ink remaining on the nozzle plate surface.
Figure 9F:
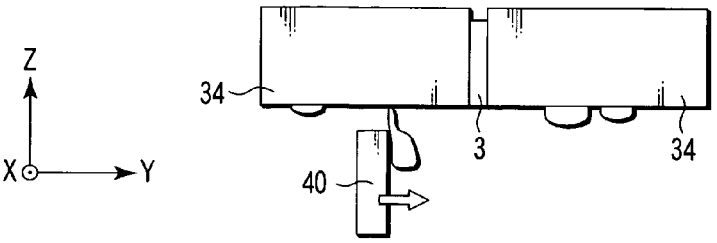
FIG. 9F is a view showing how the wiper removes the ink from the nozzle plate surface and moves in the Y axis direction.

Further, FIGS. 9A, 9B, and 9C are views showing states of the nozzle plate 34 and the wiper 40 in the contact cleaning mode where the wiper 40 is performing cleaning while being in contact with the nozzle plate 34. FIGS. 9D, 9E, and 9F are views showing states of the nozzle plate 34 and the wiper 40 in the non-contact cleaning mode where the wiper 40 is performing cleaning without being in contact with the nozzle plate 34.

An operation of the wiping portion 22 in the contact cleaning mode will be first explained.

The wiping portion 22 at the wiper home position is arranged in a state shown in FIG. 8A. That is, the wiper support shaft 41 is downwardly urged in the Z axis direction by an urging force of the spring 46. Furthermore, the engagement piece 41*b* is in contact with the lower edge of the opening portion 42*b*. Moreover, the wiper 40 is separated from the nozzle plate 34 with a small gap therebetween.

Then, the set pin 25 moves up by a non-illustrated drive mechanism. As a result, the wiper support shaft 41 is pushed to move upward by the set pin 25 against the urging force of the spring 46. The engagement piece 41*b* comes into contact with the latch portion 49*b*. Each of a distal end of the engagement piece 41*b* and a distal end of the latch portion 49*b* has an inclined surface. When the engagement piece 41*b* moves up, the latch portion 49*b* is swiveled in the Y axis direction (a right direction) in the drawing. That is, the swiveling piece 49 swivels around the swiveling supporting point 42*c* in the clockwise direction by the engagement piece 41*b* that is moving up (see FIG. 8B). The engagement piece 41*b* further moves up. Then, when the engagement piece 41*b* further moves up beyond the latch portion 49*b*, the swiveling piece 49 swivels in the counterclockwise direction by an urging force of a non-illustrated spring to return to an original position (a position shown in FIG. 8C). When the set pin 25 moves up to a predetermined position (the engagement piece 41*b* is positioned above the latch portion 49*b*), the non-illustrated drive mechanism moves down the set pin 25 to an original position (to a position shown in FIG. 8C). With downward movement of the set pin 25, the wiper support shaft 41 moves down by the urging force of the spring 46. The engagement piece 41*b* comes into contact with the upper surface of the latch portion 49*b*.

As a result, the latch portion 49*b* functions as a restricting member that restricts movement of the engagement piece 41*b*. That is, the latch portion 49*b* restricts a downward movement operation of the wiper support shaft 41, and firmly maintains the restricted state. At this time, the wiper 40 is placed at the highest position in the Z axis direction. Additionally, a height from the support base 21 to a distal end of the wiper 40 reaches a first position higher than a height from the support base 21 to the surface of the nozzle plate 34. At this time, a gap between the wiper 40 and the nozzle plate 34 is minimum, and the distal end of the wiper 40 comes into contact with the nozzle plate 34.

After the height position of the wiper 40 is set in this manner, the support base 21 relatively moves along the Y axis direction (in an arrangement direction of the nozzles 32). As a result, contact cleaning is executed.

At this time, as shown in FIG. 8D, the wiper 40 wipes away dust or a waste ink while being in contact with the nozzle plate 34. As shown in FIGS. 9A, 9B, and 9C, the wiper 40 comes into contact with the nozzle plate 34, moves on the nozzle plate 34 in an elastically deformed and bent state, and wipes away dust or a waste ink on the nozzle plate 34. The wiper 40 scans the entire surface of the nozzle plate 34 of the recording head 4 in this manner.

The wiping portion 22 moves along the Y axis direction, passes through a part of the recording head 4 facing the nozzle plate 34, and reaches the wiper cancel position. In the wiping portion 22 that has reached this position, the cancel pin 26 comes into contact with the cancel operating portion 49*c*. When the swiveling piece 49 is relatively pushed by the cancel pin 26, it swivels around the swiveling supporting point 42*c* in the clockwise direction. As a result, the latch portion 49*b* functioning as a stopper for the engagement piece 41*b* is retracted from a position below the engagement piece 41*b* (see FIG. 8E), and the wiper support shaft 41 moves down by the urging force of the spring 46. The wiper support shaft 41 moves down until the engagement piece 41*b* comes into contact with the lower edge of the opening portion 42*b* (see FIG. 8F). When the engagement piece 41*b* comes into contact with the lower edge of the opening portion 42*b*, the wiper support shaft 41 reaches the initial position shown in FIG. 8A. In this state, the entire support base 21 moves in an opposite direction along the Y axis direction to return to the wiper home position.

An operation of the wiping portion 22 in the non-contact cleaning mode will now be explained.

As shown in FIG. 8A, the wiping portion 22 is placed at the wiper home position. The engagement piece 41*b* is in contact with the lower edge of the opening portion 42*b*. The height from the support base 21 to the upper end of the wiper 40 reaches a second position slightly lower than the height from the support base 21 to the surface of the nozzle plate 34 in the recording head 4. At this time, the gap between the wiper 40 and the nozzle plate 34 is maximum, and the distal end of the wiper 40 does not come into contact with the nozzle plate 34.

In this state, the support base 21 relatively moves along the Y axis direction (the arrangement direction of the nozzles 32). As shown in FIGS. 9D, 9E, and 9F, in the non-contact cleaning state, the wiper 40 moves in a non-contact state without coming into contact with the nozzle plate 34. Usually, the ink has properties that it moves from a member having a small surface tension to a member having a large surface tension. That is, the ink moves from a member that hardly gets wet to a member that readily gets wet. In this embodiment, the ink-repellant coating is formed on the nozzle plate 34. Therefore, the wiper 40 tends to more easily get wet than the nozzle plate 34. Accordingly, the ink with a thickness larger than the gap between the wiper 40 and the nozzle plate 34 that has adhered to the nozzle plate 34 is attracted to the wiper 40 when it comes into contact with the wiper 40. As a result, the wiper 40 is not brought into contact with the nozzle plate 34, and the wiping portion 22 wipes away the ink on the nozzle plate 34.

It is to be noted that, as to wettability of the wiper 40, the fact that the wiper 40 tends to more easily get wet than the surface of the nozzle plate 34 means that a surface free energy (a surface tension of a solid matter) of the wiper 40 is higher than that of the nozzle plate 34.

When the support base 21 reaches the wiper cancel position, the cancel pin 26 comes into contact with the cancel operating portion 49*c*. As a result, the swiveling piece 49 swivels in the clockwise direction. It is to be noted that the engagement piece 41*b* is already in contact with the lower edge of the opening portion 42*b*, and the wiper support shaft 41 is placed at the lower end position. Therefore, the height position of the wiper 40 does not vary. Further, the support base 21 moves in the opposite direction along the Y axis direction to return to the wiper home position.

Figure 10:
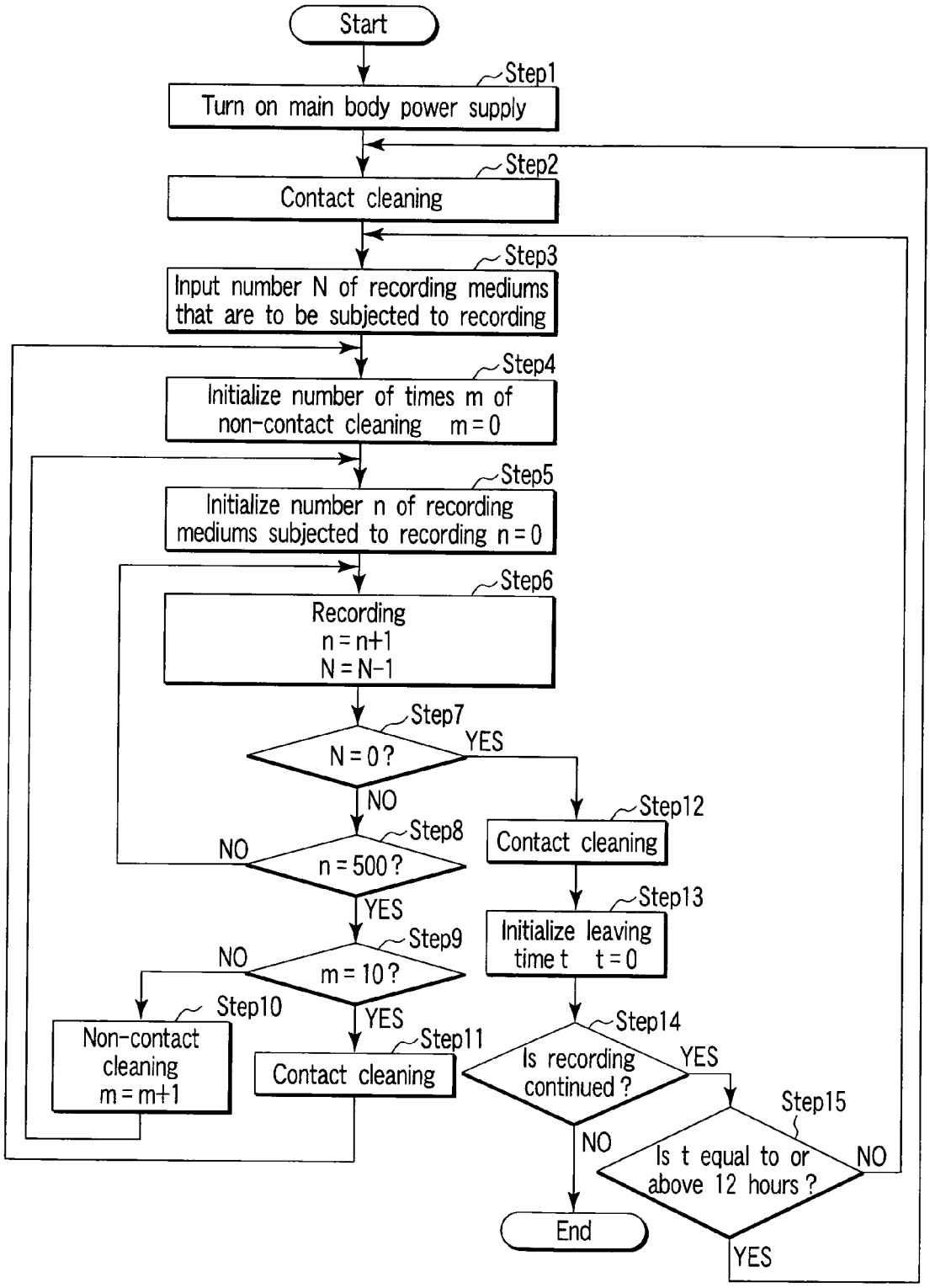
FIG. 10 is a flowchart showing timings of recording and cleaning.

How cleaning is executed in a series of image recording operations will now be explained with reference to FIG. 10. FIG. 10 is a flowchart showing timings of recording and cleaning.

When a power supply of the inkjet recording apparatus 1 is turned on (a Step 1), the inkjet recording apparatus 1 carries out contact cleaning (a Step 2). Then, the number N of recording mediums on which images are to be recorded is input to the inkjet recording apparatus 1 (a Step 3). Subsequently, the inkjet recording apparatus 1 initializes the number of times m of non-contact cleaning to be set to zero as a counter (a Step 4). Then, the inkjet recording apparatus 1 initializes the number n of the recording mediums 2 that has been recorded to be set to zero (a Step 5). Furthermore, the inkjet recording apparatus 1 increments the number n of the recording mediums 2 that has been recorded by one every time an image on each recording medium 2 and, at the same time, decrements the number N of the recording mediums 2 on which images are to be recorded thereon by one (a Step 6). Then, the inkjet recording apparatus 1 judges whether the number N of mediums on which images are to be recorded is zero (a Step 7).

When the number N of the mediums on which images are to be recorded is not zero (the Step 7: NO), the inkjet recording apparatus 1 judges whether the number n of the recording mediums 2 that has been recorded is 500 (a Step 8). If the number n of the recording mediums 2 that has been recorded is not 500 (the Step 8: NO), the control returns to the Step 6.

If the number n of the recording mediums 2 that has been recorded is 500 (the Step 8: YES), the inkjet recording apparatus 1 judges whether the number of times m of non-contact cleaning is 10 (a Step 9).

If the number of times m of non-contact cleaning is not 10 (the Step 9: NO), the inkjet recording apparatus 1 carries out non-contact cleaning and increments the number of times m of non-contact cleaning by one (a Step 10), and the control returns to the Step 5.

If the number of times m of non-contact cleaning is 10 (the Step 9: YES), the inject recording apparatus 1 carries out contact cleaning (a Step 11), and the control returns to the Step 4.

If the number N of the recording mediums 2 on which images are to be recorded is zero (the Step 7: YES), the inkjet recording apparatus 1 performs contact cleaning (a Step 12). After contact cleaning, the inkjet recording apparatus 1 initializes a leaving time t to zero (a Step 13). Then, the inkjet recording apparatus 1 judges whether recording is continued (a Step 14).

If recording is not continued (the Step 14: NO), the operation is terminated.

If recording is continued (the Step 14: YES), the inkjet recording apparatus 1 judges whether the leaving time t is equal to or above 12 hours (a Step 15). If the leaving time t is equal to or above 12 hours (the Step 15: YES), the control returns to the Step 2. If the leaving time t is not equal to or above 12 hours (the Step 15: NO), the control returns to the Step 3.

Selection of contact cleaning and non-contact cleaning according to this embodiment will now be described.

When cleaning the nozzle plate 34, the ink accumulated on the nozzle plate 34 can be removed by constantly repeatedly rubbing the ink-repellant coating by the wiper 40. However, repeatedly rubbing the ink-repellant coating by the wiper 40 may lead to damaging the ink-repellant coating. When the ink-repellant coating is damaged, an eject failure may occur.

According to this embodiment, the non-contact cleaning mode is set, and the wiper 40 is arranged at a position slightly separated from the nozzle plate 34. At this time, according to this embodiment, the ink can be removed (in a non-contact manner) while utilizing a capillary action to prevent the wiper 40 from coming into contact with the nozzle plate 34. According to this embodiment, based on this method, cleaning can be performed without damaging the ink-repellant coating on the nozzle plate 34. Therefore, according to this embodiment, stable eject can be obtained.

Furthermore, in regard to a gap between the nozzle plate 34 and the wiper 40, it is good enough to select an appropriate gap calculated based on an amount of the ink, a viscosity degree of the ink, a surface tension of the ink and others in pressure purging or suction purging at the time of cleaning.

Incidentally, according to this embodiment, it is preferable that an ink amount in pressure purging s 1.2 ml, a viscosity degree of the ink is 10 mPa·s (25° C.), a surface tension is 28 mN/m (25° C.). As to a gap between the nozzle plate 34 and the wiper 40 in non-contact cleaning, approximately 0.1 mm to approximately 1 mm is preferable. Moreover, in regard to a relationship between the nozzle plate 34 and the wiper 40, it is preferable for the wiper 40 to more easily get wet than the nozzle plate 34. For example, when a fluorine-based coating is applied to the nozzle plate 34, it is possible to use NBR (Nitrile Butadiene Rubber), silicone, SBR (Styrene Butadiene Rubber), NR (Natural Rubber), PVC (PolyVinylChloride), chloroprene rubber, EPDM (Ethylene Propylene Diene Methylene linkage), urethane or the like to the wiper 40. Some of FKMs (fluorocarbon rubbers) having a low degree of rubber hardness can be also used for the wiper 40. Additionally, when the nozzle plate 34 is formed of polyimide, NBR (Nitrile Butadiene Rubber) can be used for the wiper. According to this embodiment, a fluorine-based coating is applied to the nozzle plate 34, and the wiper is formed of FKM and has characteristics of higher wettability than the nozzle plate 34.

Meanwhile, a recording head for a single color or a plurality of recording heads that eject inks in accordance with respective colors, e.g., black (K), cyan (C), magenta (M), and yellow (Y) are provided in the inkjet recording apparatus 1. In such an inkjet recording apparatus 1, when recording an image on the recording medium 2 of a small size, some of the recording heads 4 alone are used in some cases. When the recording heads 4 that are not used are left for a long time in, e.g., a recording standby mode or a power supply OFF state, a film of the ink is formed on the ink-repellant coating on the nozzle plate 34. This film is formed when a solvent in a small amount of ink that has remained in cleaning is evaporated and the ink is thickened or solidified.

In this case, when a height of the wiper 40 is set to bring the wiper 40 into contact with the nozzle plate 34 and cleaning using a mechanical force is performed, the film can be removed.

Further, even during recording, fine ink droplets remaining on the nozzle plate 34 are accumulated, dried, and solidified in some cases. According to this embodiment, the surface of the nozzle plate 34 can be maintained in an excellent state by performing contact cleaning, i.e., cleaning utilizing a mechanical force at fixed time intervals or for the fixed number of times between non-contact cleaning operations in order to avoid solidification. A contact length of the wiper 40 with respect to the nozzle plate 34 in contact cleaning is set to, e.g., 0.5 mm to 1.5 mm.

According to this embodiment, a frequency of non-contact cleaning is set to be higher than that of contact cleaning. For example, a single non-contact cleaning operation is carried out per 500 recording mediums during recording, and a single contact cleaning operation is performed when effecting 10 non-contact cleaning operations. Therefore, according to this embodiment, abrasions of the ink-repellant coating can be greatly reduced as compared with an example where contact cleaning alone is carried out. Additionally, according to this embodiment, in cleaning after being left for a fixed time, e.g., 12 hours or more in a non-recording mode or in a printer power supply OFF mode, contact cleaning is performed. In regard to an interval between respective cleaning operations, setting an appropriate value while considering a degree of dryness or eject properties of the ink can suffice.

According to this embodiment, contact cleaning and non-contact cleaning can be selected and performed at an appropriate timing by monitoring the number of times of contact cleaning, the number of times of non-contact cleaning, the number of recording mediums 2 that has been recorded, a leaving time, and others. Therefore, according to this embodiment, an excellent state of the nozzle plate 34 can be maintained, and a frequency of contact cleaning in recording can be set lower than that of non-contact cleaning. Further, according to this embodiment, contact cleaning is not performed each time between respective recording operations, but contact cleaning is carried out when the apparatus is left for a predetermined time to greatly suppress abrasions of the ink-repellant coating.

As described above, executing non-contact cleaning like this embodiment can reduce the number of times of contact cleaning. Therefore, the ink on the nozzle plate 34 can be removed, and abrasions of the ink-repellant coating applied to the surface of the nozzle plate 34 can be suppressed, and occurrence of a eject failure of the ink can be constrained, thereby recording a high-quality image.

Figure 11:
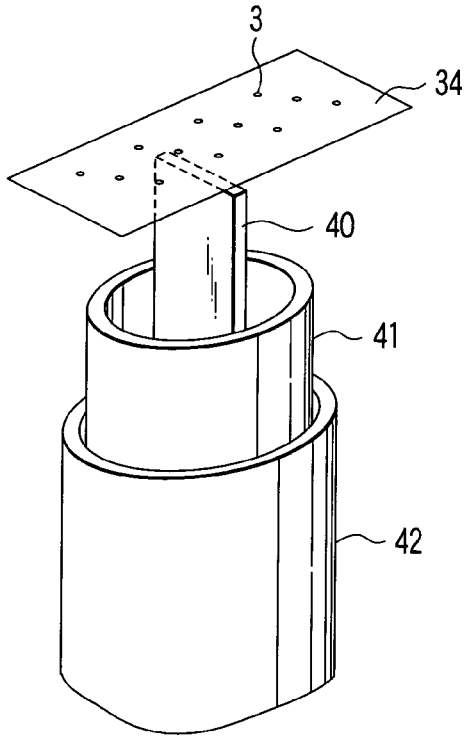
FIG. 11 shows a modification of a housing and the wiper support shaft in this embodiment.
Figure 12:
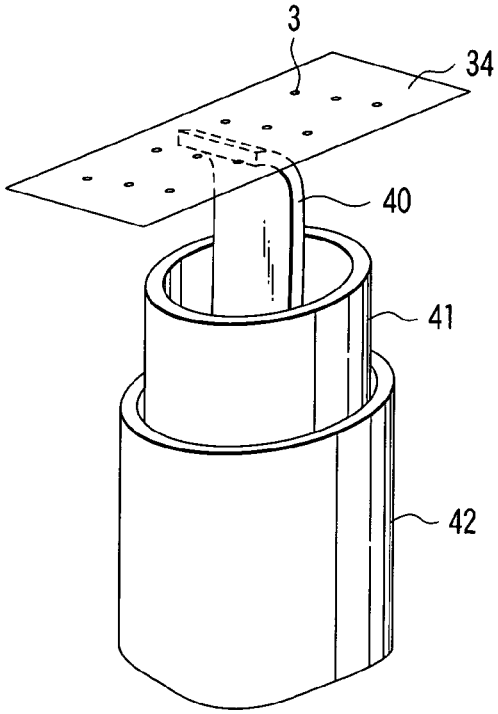
FIG. 12 shows a modification of the housing and the wiper support shaft in this embodiment.

Furthermore, the wiper support shaft 41 and the housing 42 have a rectangular solid shape in this embodiment, but they are not restricted to such a shape. For example, they may have a cylindrical shape as shown in FIGS. 11 and 12.

It is to be noted that, as the mechanism that adjusts the gap between the wiper 40 and the nozzle plate 34, a link mechanism or an elastic member may be used besides the mechanism utilizing the set pin 25. Moreover, according to this embodiment, the support base 21 may be moved up in the Z axis direction to adjust the gap between the wiper 40 and the nozzle plate 34.

A second embodiment will now be explained in detail with reference to FIGS. 13, 14, 15A, 15B, 16A, 16B, 16C, 16D, 16E, 16F, 17A, 17B, and 17C.

A wiping portion 22 according to this embodiment has a structure different from that of the wiping portion 22 in the first embodiment. Structures other than the wiping portion 22 according to this embodiment are the same as those in the first embodiment, thereby omitting a detailed explanation thereof. Additionally, like reference numerals denote parts equal to those in the first embodiment, thereby omitting a detailed explanation thereof.

Figure 13:
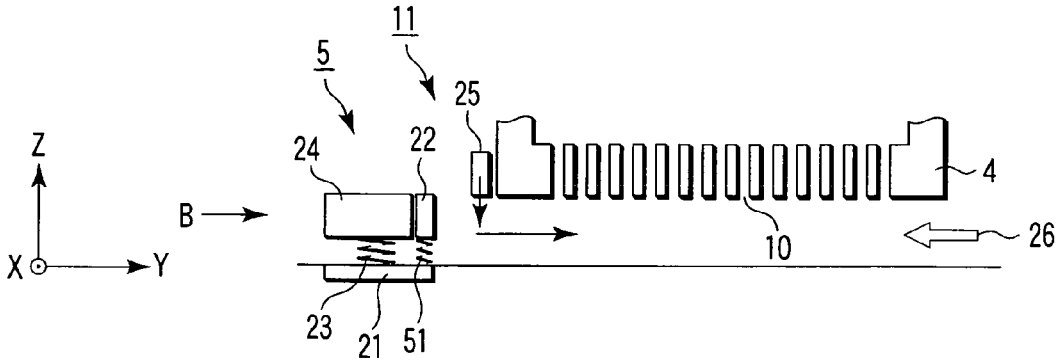
FIG. 13 is a schematic side view of a periphery of a recording head according to a second embodiment.
Figure 14:
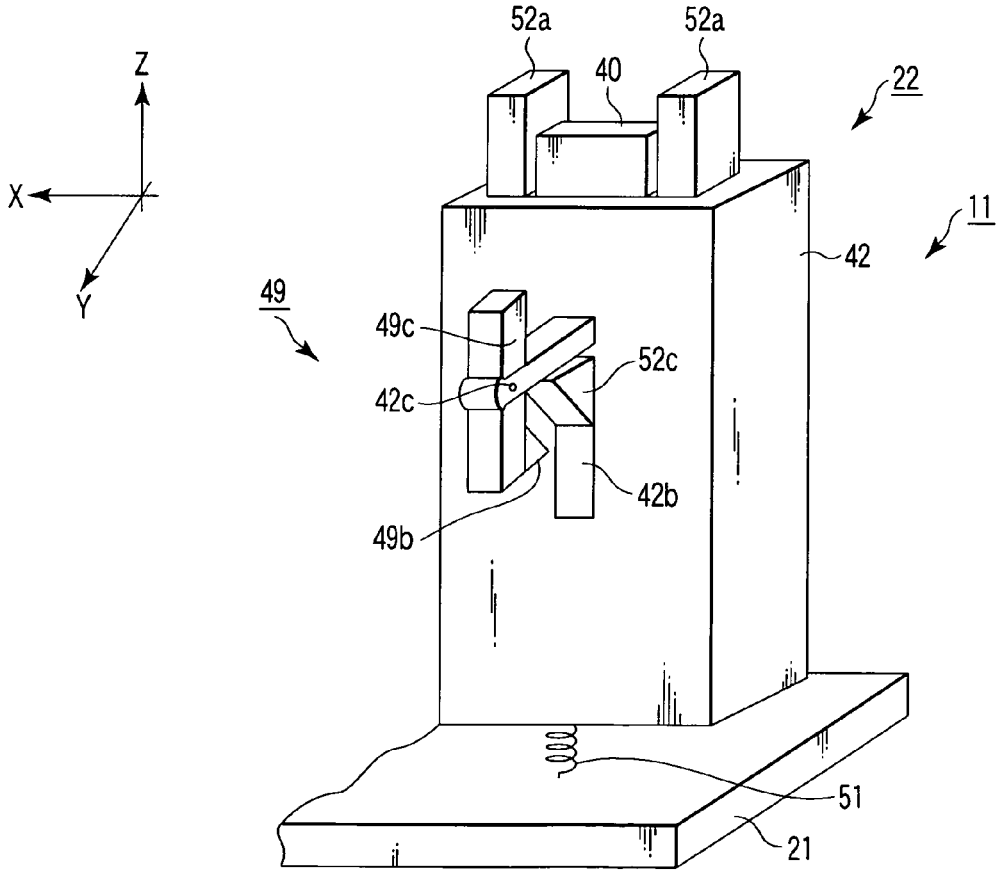
FIG. 14 is a schematic perspective view of a periphery of a recording head according to a second embodiment.
Figure 15A:
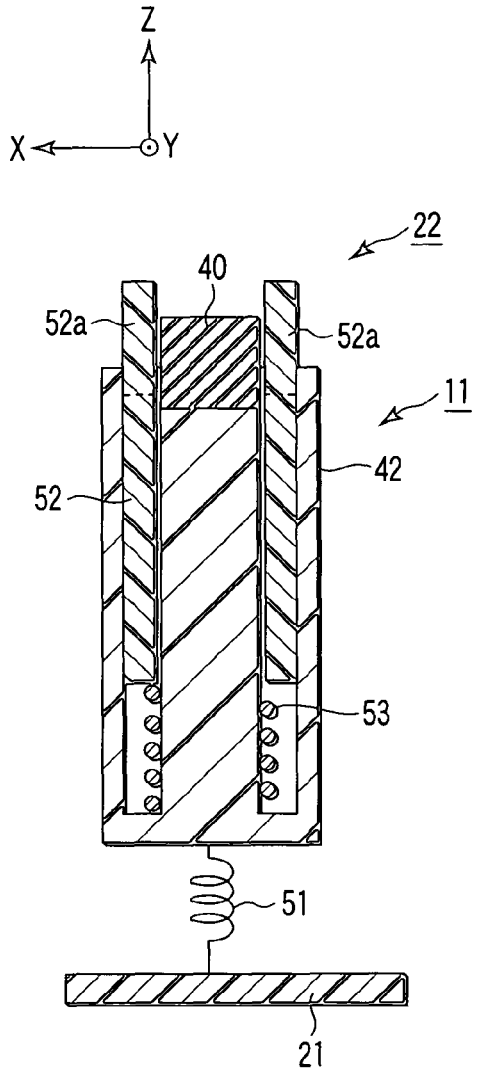
FIG. 15A is a cross-sectional view (a cross-sectional view showing a wiping portion 22 from a Y axis direction) taken along a line segment A-A depicted in FIG. 15B.
Figure 15B:
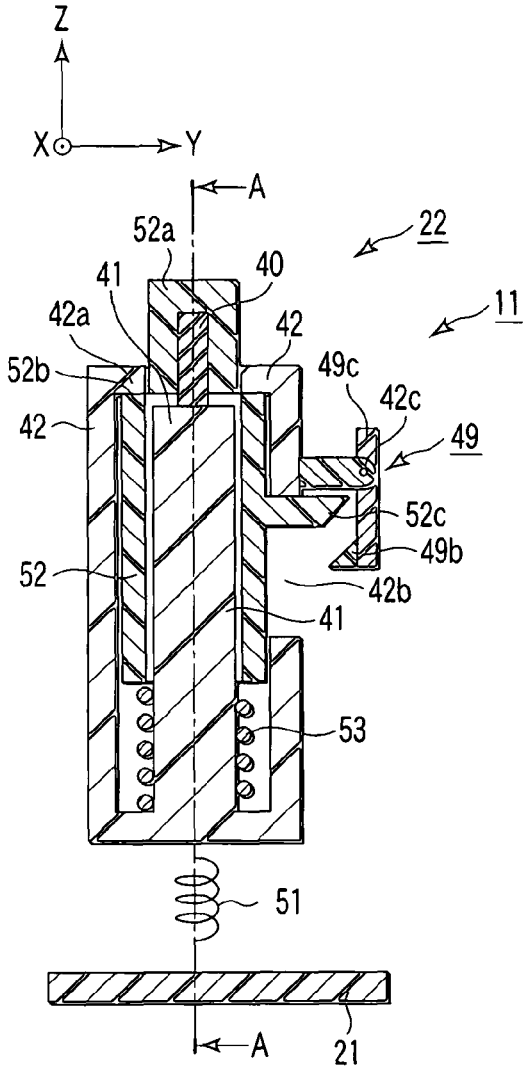
FIG. 15B is a schematic side cross-sectional view of the wiping portion.

FIG. 13 is a schematic side view of a periphery of a recording head 4. FIG. 14 is a schematic perspective view of a periphery of a wiping portion 22. FIG. 15A is a cross-sectional view taken along a line segment A-A depicted in FIG. 15B (a cross-sectional view showing the wiping portion 22 from the Y axis direction). FIG. 15B is a schematic side cross-sectional view of the wiping portion 22. FIGS. 16A, 16B, 16C, 16D, 16E, and 16F are schematic side views explaining a movement structure of the wiping portion 22. It is to be noted that a suction nozzle 24 and a spring 23 are omitted in FIGS. 16A, 16B, 16C, 16D, 16E, and 16F like FIGS. 8A, 8B, 8C, 8D, 8E, and 8F. FIG. 17A is a side view showing the suction nozzle 24 from a direction B depicted in FIG. 13, FIG. 17B is a side view showing that a wiper 40 is in contact with a nozzle plate 34 from an X axis direction, and FIG. 17C is a side view showing that the wiper 40 is not in contact with the nozzle plate 34 from the X axis direction.

As shown in FIG. 13, in a cleaning unit 5 are provided a support base 21 that faces nozzles 3 and can move along a traveling direction along which a cleaning operation is performed, a wiping portion 22 that is provided on the support base 21 and removes an ink on the nozzle plate 34, and a suction nozzle 24 that is the same as that in the first embodiment. It is to be noted that the wiping portion 22 and the suction nozzle 24 are provided on the support base 21 through, e.g., springs 51 and 23 as respective elastic members.

FIGS. 14, 15A, and 15B show the wiping portion 22 according to this embodiment. In the wiping portion 22 are provided a wiper 40 as an elastic member, a wiper support shaft 41 that supports the wiper 40, a cover 52 provided at both ends of the wiper 40 in the X axis direction, and a housing 42 that fixes the wiper support shaft 41 and holds the cover 52 to be movable in a Z axis direction. Further, a part of a gap adjustment mechanism 11 is arranged in the wiping portion 22.

The wiper support shaft 41 is a rectangular shaft-like member extending in the Z axis direction, and holds the wiper 40 on an upper surface thereof in the Z axis direction. The wiper support shaft 41 is fixed on a bottom surface of the housing 42 in such a manner that it is arranged in the hollow housing 42. It is to be noted that heights of the wiper 40 and the wiper support shaft 41 are set in such a manner that a distal end of the wiper 40 held by the wiper support shaft 41 extends beyond the upper surface of the housing 42 in the Z axis direction.

The cover 52 is a hollow quadratic-prism-like member, and the wiper support shaft 41 is positioned in the hollow portion thereof. The cover 52 is provided in the housing 42 to be movable along the extending direction of the wiper support shaft 41. A pair of cover portions 52*a* are formed on the upper surface of the cover 52 in the Z axis direction. The cover portions 52*a* are positioned on both sides of the wiper 40 in the width direction thereof. A width of the cover portion 52*a* (a length in a Y axis direction) is formed to be narrower than a width of a main body portion of the cover 52. A step portion 52*b* formed of a difference in width between the cover portion 52*a* and the main body portion of the cover 52 comes into contact with a spring engagement portion 42*a*. As a result, upward movement of the cover 52 in the Z axis direction is restricted. Further, an engagement piece 52*c* that extends in the Y axis direction and restricts movement of the cover 52 in the Z axis direction is formed on the cover 52. This engagement piece 52*c* pierces an opening portion 42*b* formed in the later-described housing 42 and extends to an outer side surface of the housing 42. A spring 53 as an elastic member is disposed at a lower end of the cover 52. The spring 53 upwardly urges the cover 52 in the Z axis direction with respect to the housing 42.

The housing 42 is a hollow member. The wiper support shaft 41 is fixed in the housing 42. The housing 42 supports cover 52 through the spring 53 to be movable in the Z axis direction. A spring 51 is disposed on the bottom surface of the housing 42. The housing 42 is attached to an upper surface of the support base 21 through the spring 51.

Furthermore, an opening portion 42*b* is formed in the side surface of the housing 42 on a front side in a traveling direction along which a cleaning operation is performed in such a manner that the opening portion 42*b* extends along the Z axis direction. The engagement piece 42*c* is inserted into this opening portion 42*b*. The engagement piece 52*c* comes into contact with the upper edge and the lower edge of the opening portion 42*b* in the Z axis direction. As a result, movement of the cover 52 in the Z axis direction is restricted.

Moreover, a swiveling supporting point 42*c* of a swiveling piece 49 is provided on the side surface of the housing 42 on the front side in the traveling direction along which a cleaning operation is performed. The swiveling piece 49 is supported on an axis of this swiveling supporting point 42*c* to allow its swiveling motion. This swiveling piece 49 is a tabular member, and a latch portion 49*b* is formed at a lower end thereof in the Z axis direction. A cancel operating portion 49*c* with which a later-explained cancel pin 26 comes into contact is formed on the swiveling piece 49. This swiveling piece 49 is urged in a clockwise direction in FIG. 15B by a non-illustrated spring.

The support base 21 supports the housing 21 through the spring 51 in such a manner that the entire housing 42 can move along the Z axis direction.

The spring 51 is interposed between the support base 21 and the housing 42 and upwardly urges the housing 42 in the Z axis direction. It is to be noted that an elastic force of this spring 51 is set to be weaker than that of the spring 53 arranged between the cover 52 and the housing 42. Therefore, when the cover 52 is pushed from above, the spring 51 is first contracted, and then the spring 53 is contracted after the spring 51 is completely contracted.

A pair of set pins 25 (a second adjustment member) that bring the wiper 40 into contact with the nozzle plate 34 are provided at a wiper home position. The set pins 25 are included in a gap adjustment mechanism 11. In more detail, in a state where the cleaning unit 5 is placed at the wiper home position, the two set pins 25 are provided at upper positions in the Z axis direction where they face the cover portions 52*a*. This pair of set pins 25 can move in the Z axis direction by a non-illustrated drive mechanism, and downwardly push the cover portions 52*a* when they move down.

When the set pins 25 move down, the set pins 25 come into contact with the two cover portions 52*a* and further downwardly push the cover 52.

When the cover 52 is pushed from above, the spring 51 is first contracted because of a relationship in elastic force amount between the springs 51 and 53. Therefore, a position of the cover 52 in the housing 42 does not change, and the entire housing 42 including the cover 52 moves down.

The spring 51 is contracted to enter a state where it cannot be contracted any further (the housing 42 reaches a downward movement lower limit position), and the cover 52 is further pushed by the set pins 25. Then, the spring 53 is contracted. As a result, the cover 52 moves down in the housing 42. When the cover 52 moves down, the engagement piece 52*c* moves (moves down) in the opening portion 42*b*, and the engagement piece 52*c* comes into contact with the latch portion 49*b*. At the time of contact, the engagement piece 52*c* further moves down against the swiveling piece 49 urged by a non-illustrated spring while swiveling the swiveling piece 49 in the counterclockwise direction in FIG. 15B.

When the engagement piece 52*c* further moves down beyond the latch portion 49*b*, the swiveling piece 49 again further swivels in the clockwise direction in FIG. 15B by an urging force of the non-illustrated spring. As a result, the latch portion 49*b* is placed above the engagement piece 52*c*. In this state, when the set pins 25 move up, the cover 52 moves up in the Z axis direction by the urging force of the spring 53. At the time of upward movement, an upper surface of the engagement piece 52*c* comes into contact with a lower surface of the latch portion 49*b*. As a result, an upward moving operation of the cover 52 in the housing 42 is restricted. That is, when the latch portion 49*b* comes into contact with the engagement piece 52*c*, movement of the cover 52 in the housing 42 is restricted, and this state is maintained. A height of the upper surface of the cover 52*a* at this moment is lower than a height of the upper end of the wiper 40 so that the upper end of the wiper 40 is exposed.

It is to be noted that, when the set pins 25 move up, the entire housing 42 moves up with respect to the support base 21 by the urging force of the spring 51.

Furthermore, a cancel pin 26 as the gap adjustment mechanism 11 is provided at a wiper cancel position. The cancel pin 26 moves the wiper 40 to be retracted from the recording head 4 along the Z axis direction. The cancel pin 26 is provided at a position where it can come into contact with the cancel operating portion 49*c*. When the cleaning unit 5 moves to approach the cancel pin 26 and the cancel operating portion 49*c* comes into contact with the cancel pin 26, the cancel pin 26 swivels the swiveling piece 49 in the counterclockwise direction. As a result, the latch portion 49*b* is retracted from a position above the engagement piece 52*c*. Consequently, the cover 52 moves up in the housing 42 by the urging force of the spring 53. The cover 52 moves up until the engagement piece 52*c* comes into contact with the upper edge of the opening portion 42*b* in the housing 42.

Operations in non-contact cleaning and contact cleaning and operations of the wiping portion 22 in respective cleaning modes will now be explained with reference to FIGS. 15A, 15B, 16A, 16B, 16C, 16D, 16E, and 16F. It is to be noted that the suction nozzle 24 and the spring 23 are omitted in FIGS. 16A, 16B, 16C, 16D, 16E, and 16F like FIGS. 15A and 15B.

Figures 16A, 16B, 16C, 16D, 16E, 16F:
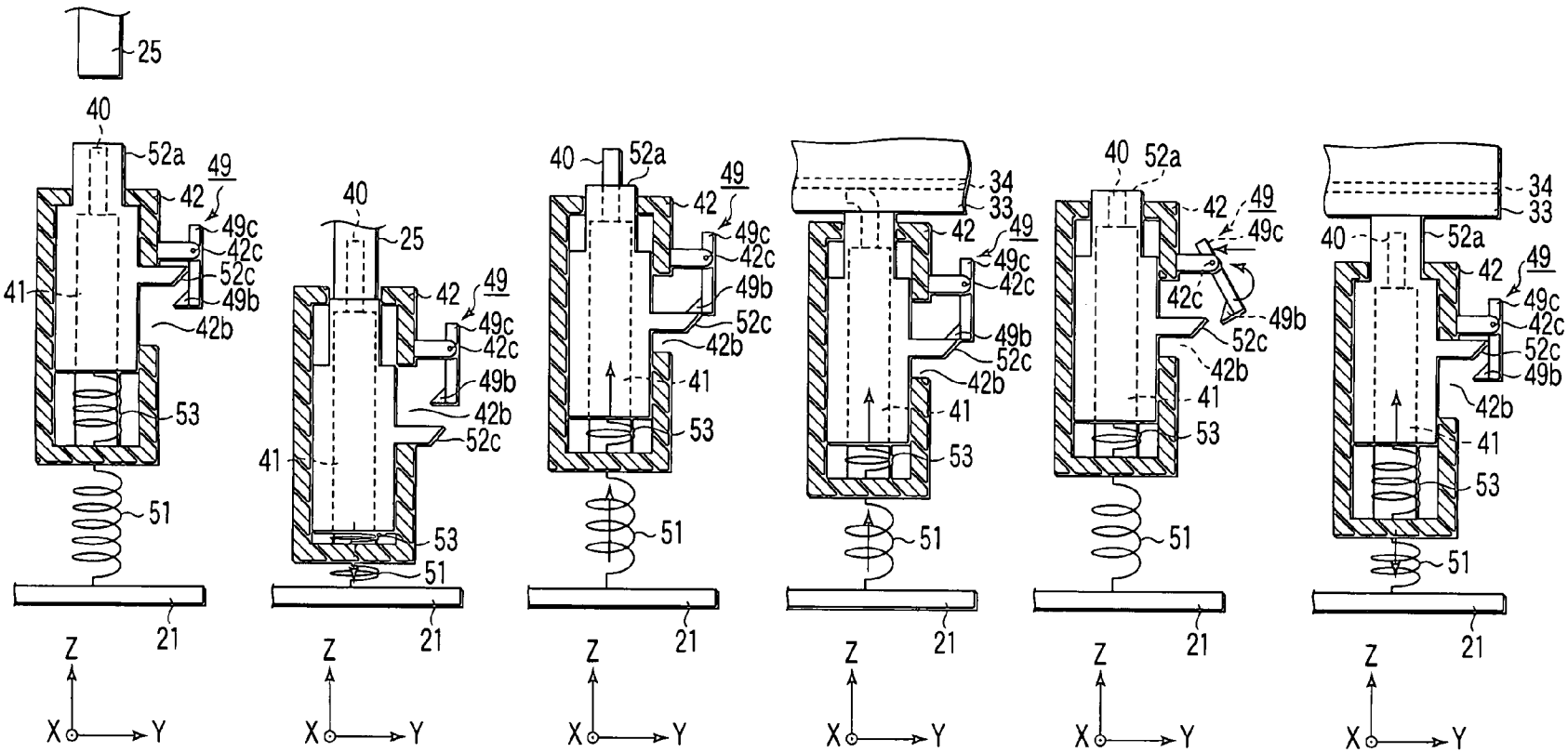
FIG. 16A shows a state where a load with respect to a cover is not generated at all at a wiper home position, i.e., a so-called free state and also a state where a cover portion is placed at the highest position in a Z axis direction.
FIG. 16B shows a state where the cover is pressed from above by a set pin, both springs are compressed at maximum, and the housing and the cover are moved down to the lowest position at the wiper home position.
FIG. 16C shows a state where the set pin is moved up and an engagement piece of the cover engages with a latch portion, and a state where the entire housing is moved up with respect to the support base by an urging force of the spring.
FIG. 16D shows a state where the wiper performs contact cleaning with respect to the nozzle plate.
FIG. 16E shows a state where a cancel operating portion of a swiveling piece is in contact with a cancel pin and also a state where the wiper shifts from a contact condition to a non-contact condition with respect to the nozzle plate at a wiper cancel position.
FIG. 16F shows a state where the wiper performs non-contact cleaning with respect to the nozzle plate 34.
Figure 17C:
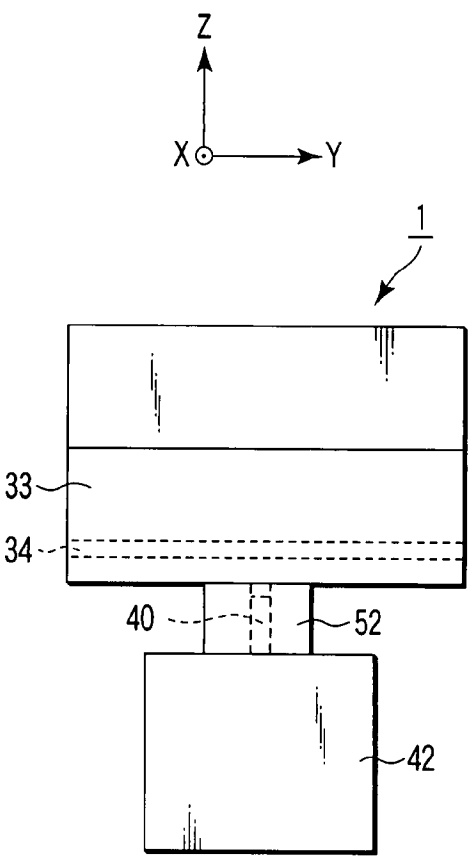
FIG. 17C is a side view showing that the wiper is not in contact with the nozzle plate from the X axis direction.
Figure 17B:
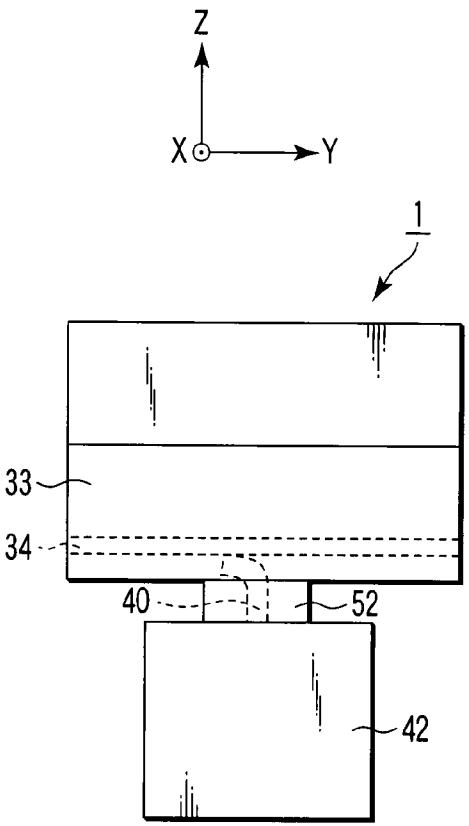
FIG. 17B is a side view showing that the wiper is in contact with the nozzle plate from an X axis direction.
Figure 17A:
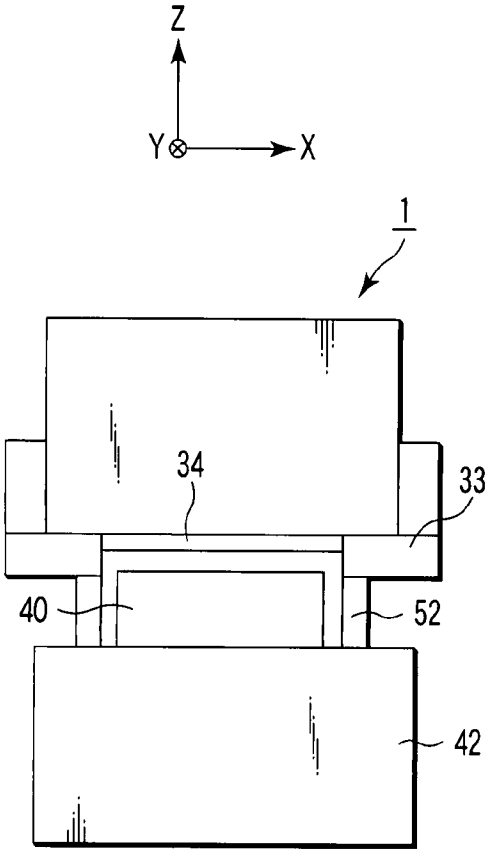
FIG. 17A is a side view showing a suction nozzle from a direction B depicted in FIG. 13.

FIG. 16A shows a state where no load with respect to the cover 52 occurs at all at the wiper home position, i.e., a so-called free state, and also a state where the cover portions 52*a* of the cover 52 are placed at the highest positions in the Z axis direction.

FIG. 16B shows a state where the cover 52 is pushed from above by the set pins 25, both the springs 51 and 53 are contracted at maximum, and the housing 42 and the cover 52 are moved down at maximum at the wiper home position.

FIG. 16C shows a state where the set pins 25 move up and the engagement piece 52*c* of the cover 52 and the latch portion 49*b* are engaged with each other, and also a state where the entire housing 42 are moved up with respect to the support base 21 by the urging force of the spring 51.

FIG. 16D shows a state where the wiper 40 performs contact cleaning with respect to the nozzle plate 34.

FIG. 16E shows a state where the cancel operating portion 49*c* of the swiveling piece 49 is in contact with the cancel pin 26, and also a state where the wiper 40 shifts from a contact state to a non-contact state with respect to the nozzle plate 34 at the wiper cancel position.

FIG. 16F shows a state where the wiper 40 performs non-contact cleaning with respect to the nozzle plate 34.

An operation of the wiping portion 22 in the contact cleaning mode will be first explained.

The wiping portion 22 at the wiper home position is arranged in a state depicted in FIG. 16A. That is, the housing 42 is placed at an upper position in the Z axis direction with respect to the support base 21 by the urging force of the spring 51, the engagement piece 52*c* comes into contact with the upper edge of the opening portion 42*b* by the urging force of the spring 53, and the cover 52 is placed at the highest position in the Z axis direction. At this time, in the cover 52, the cover portions 52*a* arranged on both sides of the wiper 40 extend upward beyond the upper surface of the wiper 40 in the Z axis direction. Moreover, a height from the support base 21 to the upper surface of each cover portion 52*a* and the upper surface of the wiper 40 is larger than a height from the support base 21 to the surface of the nozzle plate 34.

Then, the set pins 25 move down by the non-illustrated drive mechanism. The set pins 25 downwardly push the cover 52 from above. An elastic force of the spring 53 supporting the cover 52 is larger than an elastic force of the spring 51. Therefore, the spring 51 is contracted before the spring 53 is contracted. That is, when the set pins 25 downwardly push the cover 52, a position of the cover 52 in the housing 42 does not vary, but the entire housing 42 moves down.

When the spring 51 enters a state where it cannot be contracted any further (when the housing 42 reaches a downward movement lower limit position), then the spring 53 starts to contract as shown in FIG. 16B, and the cover 52 moves down in the housing 42.

The cover 52 moves down, and the engagement piece 52*c* comes into contact with the latch portion 49*b*. Each of the engagement piece 52*c* and the latch portion 49*b* has an inclined surface at a distal end thereof. When the engagement piece 52*c* moves down, the latch portion 49*b* is pushed in the Y axis direction (a right direction) in the drawing. The swiveling piece 49 is swiveled in the counterclockwise direction by a moving force of the engagement piece 52*c* in the Z axis direction, and retracted from a movement path of the engagement piece 52*c*. Further, when the engagement piece 52*c* further downwardly moves down beyond the latch portion 49*b*, the swiveling piece 49 swivels in the clockwise direction by the urging force of the non-illustrated spring and returns to its original position (a position shown in FIG. 16B). FIG. 16B shows a state where the springs 51 and 53 are pushed by the set pins 25 to be contracted at maximum. In more detail, this drawing shows a state where both the housing 42 and the cover 52 reach the lower limit positions in the downward movement range.

From this state shown in FIG. 16B, the non-illustrated drive mechanism for the set pins 25 moves up the set pins 25 to the original position, i.e., a position shown in FIG. 16A. When the set pins 25 move up, the cover 52 moves up by the urging force of the spring 53. Furthermore, the upper surface of the engagement piece 52*c* comes into contact with the lower surface of the latch portion 49*b* (see FIG. 16C). The latch portion 49*b* functions as a restricting member that restricts movement of the engagement piece 52*c*, restricts the upward movement operation of the cover 52 by the urging force of the spring 53, and firmly maintains this state. When the set pins 25 further move up, the housing 42 further moves up by the urging force of the spring 51. In detail, the housing 42 moves up to reach the same height as that of the housing 42 depicted in FIG. 16A.

When the set pins 25 further move up, the set pins 25 are separated from the cover portions 52*a*. In the wiping portion 22 from which the pushing force by the set pins 25 is removed, the wiper 40 extends in the Z axis direction apart from the cover portions 52*a* to be exposed. At this time, the upper end of the wiper 40 is placed above the surface of the nozzle plate 34 of the recording head 4. Moreover, the cover portions 52*a* is positioned above a mask plate 33 (see FIG. 16C).

Then, when the support base 21 is moved along the Y axis direction, the wiping portion 22 is moved along the Y axis to execute contact cleaning.

As shown in FIG. 16C, the upper surfaces of the cover portions 52*a* are placed above the surface of the mask plate 33. Therefore, when performing contact cleaning, the cover 52 must be moved in such a manner that the upper surfaces of the cover portions 52*a* become level with the surface of the mask plate 33. Therefore, when the wiping portion 22 moves to a position below the recording head 4 (a range opposed to the mask plate 33) (when the support base 21 moves in the traveling direction along which the cleaning operation is performed), the wiping portion 22 uses a non-illustrated guide to gradually move down the housing 42. As a result, the upper surfaces of the cover portions 52*a* come into contact with the surface of the mask plate 33.

FIG. 16D shows a state where contact cleaning is executed. The housing 42 is upwardly urged by the urging force of the spring 51. Additionally, the cover portions 52*a* come into contact with the mask plate 33 by the urging force of this spring 51. When the cover portions 52*a* come into contact with the mask plate 33, the wiper 40 is elastically brought into contact with the nozzle plate 34, and elastically deformed and bent. In this state, when the support base 21 moves in the Y axis direction, the wiper 40 wipes the nozzle plate 34 while being in contact with the nozzle plate 34. In this manner, the wiper 40 scans the entire surface of the nozzle plate 34.

When the wiping portion 22 moves in the Y axis direction and passes through the part opposed to the nozzle plate 34, the contact state achieved between the mask plate 33 and the cover 52 is released. Therefore, the entire housing 42 moves up to reach the height shown in FIG. 16C by the urging force of the spring 51. In this state, the support base 21 is further moved in the Y axis direction to reach the wiper cancel position. At this moment, the cancel operating portion 49*c* comes into contact with the cancel pin 26 fixed at the wiper cancel position. When the swiveling piece 49 is pushed by the cancel pin 26, it swivels in the counterclockwise direction around the swiveling supporting point 42*c*. As a result, the latch portion 49*b* functioning as the stopper for the engagement piece 52*c* is retracted from the position above the engagement piece 52*c* (see FIG. 16E). When engagement achieved between the engagement piece 52*c* and the latch portion 49*b* is released, the cover 52 moves up in the housing 42 by the urging force of the spring 53. The cover 52 moves up until the engagement piece 52*c* comes into contact with the upper edge of the opening portion 42*b* of the housing 42. As a result, the same state as that shown in FIG. 16A is provided, i.e., the cover portions 52*a* are placed at the highest position. Further, the distal end of the wiper 40 is placed at a position slightly lower than the upper surfaces of the cover portions 52*a*.

An operation of the wiping portion 22 in the non-contact cleaning mode will now be explained.

The wiping portion 22 is placed at the wiper home position.

From this state, the support base 21 moves along the traveling direction (along the Y axis direction) where the cleaning operation is performed. When the housing 42 moves from the wiper home position to the position opposed to the recording head 4, the housing 42 is moved down by the non-illustrated guide against the urging force of the spring 51. The upper surface of the cover 52 that has moved down moves close to the surface of the mask plate 33. At this time, the cover 52 is placed at the highest position in a movement range in the housing 42 by the urging force of the spring 53. Therefore, the upper surfaces of the cover portions 52*a* are placed at the higher position than that of the upper end of the wiper 40 in the housing 42.

When the support base 21 further moves in the traveling direction along which the cleaning operation is performed and the upper surfaces of the cover portions 52*a* reach a position opposed to the nozzle plate 34, the housing 42 is urged toward the recording head 4 by the urging force of the spring 51. In detail, the upper surfaces of the cover portions 52*a* are pushed by the urging forces of the springs 51 and 53 to come into contact with the upper side of the mask plate 33 (see FIG. 16F).

Moreover, the cover 52 is placed at an upper position along the Z axis direction to constantly cover the wiper 40 by the urging force of the spring 53. Therefore, the wiper 40 does not come into contact with the nozzle plate 34.

Accordingly, the wiper 40 does not come into contact with the nozzle plate 34 placed above the mask plate 33. Therefore, in non-contact cleaning, an ink-repellant coating formed on the nozzle plate 34 is not damaged. It is to be noted that, in non-contact cleaning, the height position of the wiper 40 is set to a height (a gap) that allows wiping away the ink on the nozzle plate 34 although the wiper 40 does not come into contact with the nozzle plate 34.

This state is maintained, and the wiper 40 passes through a region of the recording head 4 facing the nozzle plate 34 to move to the wiper cancel position.

The wiping portion 22 according to this embodiment is configured to hold the housing 42 with respect to the support base 21 through the spring 51 and further hold the cover 52 with respect to the housing 42 via the spring 53. According to this structure, even if the support base 21 is inclined or the height position is uneven in the Z axis direction, the cover 52 is pushed by the springs 51 and 53. Therefore, the cover 52 can assuredly come into contact with the mask plate 33. Additionally, since the elastic force of the spring 53 is set higher than that of the spring 51, the cover 52 demonstrates a positioning function. Therefore, according to this embodiment, a positional accuracy of the wiper 40 in the Z axis direction in non-contact wiping can be readily set.

Timings of basic recording and cleaning according to this embodiment are the same as those in the first embodiment, thereby omitting a description thereof. According to this embodiment, combining contact cleaning with non-contact cleaning allows cleaning the nozzle plate for a long time without provoking clogging and without abrading the ink-repellant coating. Therefore, according to this embodiment, the ink can be stably ejected, and a high-quality image can be recorded.

A third embodiment will now be explained in detail with reference to FIGS. 18, 19, 20, 21A, 21B, 21C, and 21D.

A wiping portion 22 in this embodiment has a structure different from those of the wiping portions 22 in the first and the second embodiments. Other structures than the wiping portion 22 in this embodiment are the same as those in the first embodiment, thereby omitting a detailed explanation thereof. Further, like reference numerals denote parts equal to those in the first embodiment, thereby omitting a detailed explanation thereof.

Figure 18:
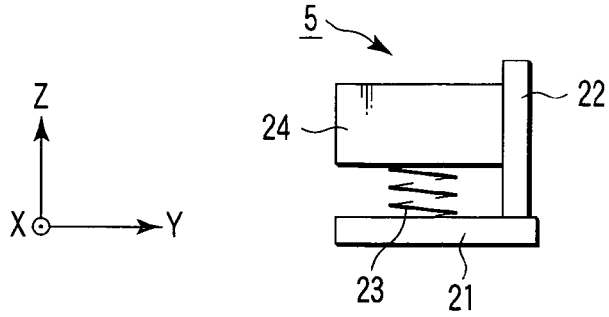
FIG. 18 is a schematic side view of a cleaning unit according to a third embodiment.
Figure 19:
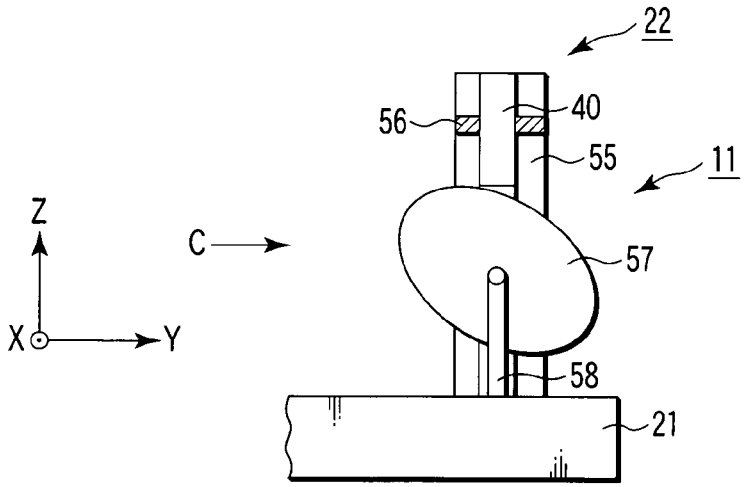
FIG. 19 is an enlarged view of a periphery of a wiping portion.
Figure 20:
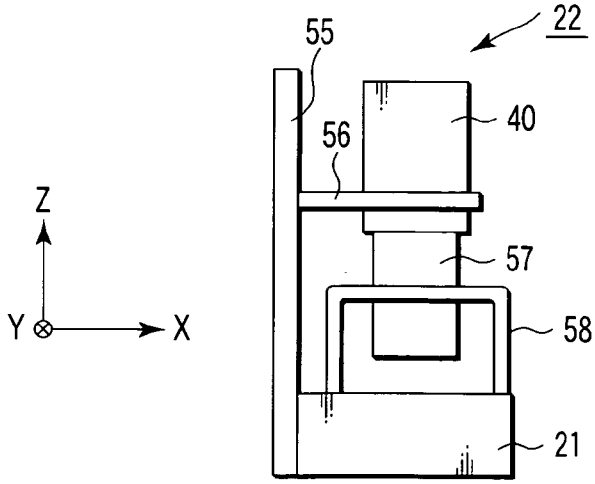
FIG. 20 is a side view showing the wiping portion from a direction C depicted in FIG. 19.
Figure 21A:
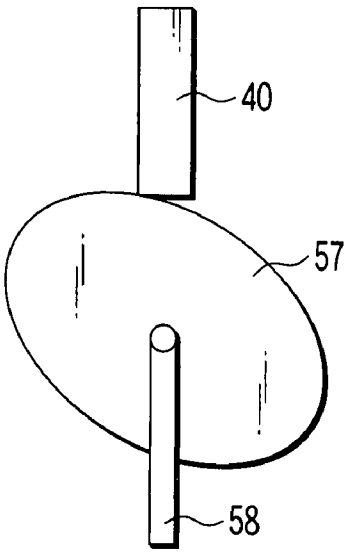
FIG. 21A is a view showing how a rotary member rotates.
Figure 21B:
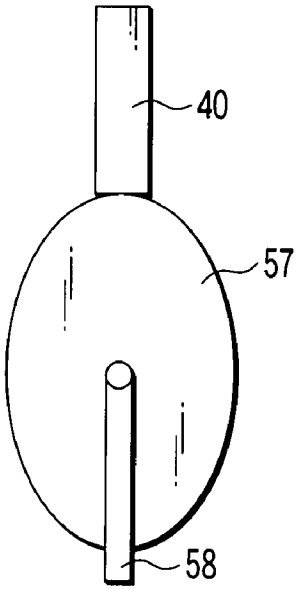
FIG. 21B is a view showing how the rotary member rotates.
Figure 21C:
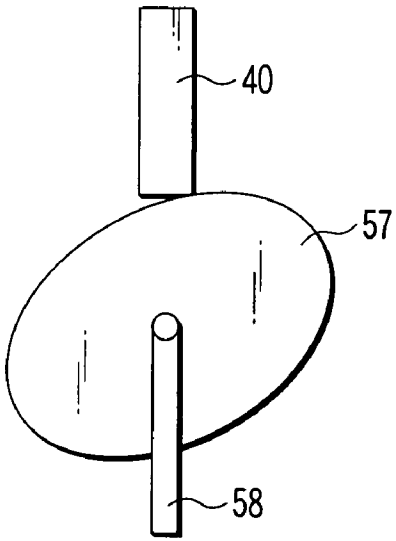
FIG. 21C is a view showing how the rotary member rotates.
Figure 21D:
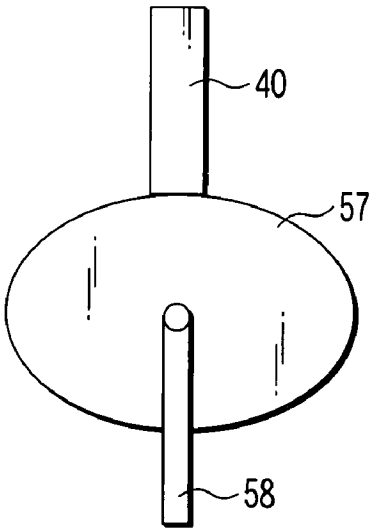
FIG. 21D is a view showing how the rotary member rotates.

FIG. 18 is a schematic side view of a cleaning unit 5. FIG. 19 is an enlarged view of a periphery of a wiping portion 22. FIG. 20 is a side view showing the wiping portion 22 from a direction C depicted in FIG. 19. FIGS. 21A, 21B, 21C, and 21D are views showing how a rotary portion 57 rotates.

As shown in FIGS. 18, 19 and 20, the wiping portion 22 according to this embodiment is provided on a support base 21. The wiping portion 22 has a gap adjustment mechanism 11. In the wiping portion 22 are provided a plate 55 provided on a side surface of the support base 21, a wiper 40 that cleans a nozzle plate 34, a wiper holder 56 that supports the wiper 40 and is vertically movable in a non-illustrated slit formed in the plate 55, a rotary portion 57 that is provided below the wiper holder 56 and above the support base 21, has an elliptic shape, and has a thickness corresponding to a width of the wiper 40, and a pillar 58 that is provided on the support base 21 to support the rotary portion 57. The rotary portion 57 having the elliptic shape can rotate without restraint by a non-illustrated power. Furthermore, as shown in FIGS. 21A, 21B, 21C, and 21D, a height of the wiper 40 can be arbitrarily changed by varying a position at which the rotary portion 57 stops. A major-axis radius, a minor-axis radius, and a rotation angle of the rotary portion 57 can be selected in accordance with a gap between a nozzle plate 34 of a recording head 4 and the wiper 40.

A height of the wiper 40 is adjusted at a wiper home position to which the cleaning unit 5 is retracted like the first embodiment (see FIG. 2). Cleaning by the wiper 40 is carried out at a position below the recording head 4, i.e., a position opposed to the nozzle plate 34 (a cleaning range). Adjustment to restore the wiper 40 to its original height (separate the wiper 40 from the nozzle plate 34) is carried out at a wiper cancel position as an end edge of the movement range of the cleaning unit 5.

Timings of basic recording and cleaning are the same as those in the first embodiment.

According to this embodiment, the rotary portion 57 having the elliptic shape rotates without restraint by a non-illustrated power, and stops at an arbitrary position. A height position of the wiper holder 56 can be changed by rotation of the rotary portion 57. The height position of the wiper holder 56 can be changed based on the major-axis radius, the minor-axis radius, and the rotation angle of the rotary portion 57. Therefore, the height position of the wiper 40 supported by the wiper holder 56 can be adjusted. In this manner, a relative gap between the wiper 40 and the nozzle plate 34 can be changed on multiple stages.

As described above, according to this embodiment, changing the relative gap allows selectively effecting contact cleaning and non-contact cleaning. The relative gap can be set on three or more stages in accordance with, e.g., a magnitude of cleaning or a type of an ink.

According to this embodiment, contact cleaning and non-contact cleaning can be performed by changing the relative gap between the wiper 40 and the nozzle plate 34 on multiple stages. In this embodiment, combining contact cleaning with non-contact cleaning allows cleaning the nozzle plate for a long time without provoking clogging and without abrading an ink-repellant coating. Therefore, according to this embodiment, the ink can be stably ejected, and a high-quality image can be recorded.

Furthermore, since the gap adjustment mechanism 11 is arranged in the wiping portion 22 alone, the apparatus can be reduced in size.

A fourth embodiment will now be described in detail with reference to FIG. 22.

A wiping portion 22 according to this embodiment has a structure different from those of the wiping portions 22 according to the first, the second, and the third embodiments. Other structures than the wiping portion 22 in this embodiment are the same as those in the first embodiment, thereby omitting a detailed explanation thereof. Furthermore, like reference numerals denote parts equal to those in the first embodiment, thereby omitting a detailed explanation thereof.

Figure 22:
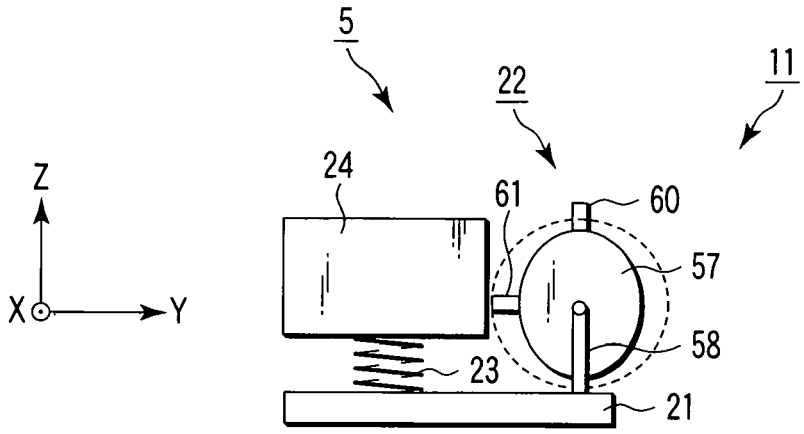
FIG. 22 is a schematic side view of a cleaning unit according to a fourth embodiment.

FIG. 22 is a schematic side view of a cleaning unit 5. A dotted line in the drawing is a line indicative of a trajectory of a wiper 61 when a rotary portion 57 rotates.

The wiping portion 22 is provided on a support base 21. The wiping portion 22 has a gap adjustment mechanism 11. In the wiping portion 22 are provided two wipers 60 and 61 that clean a nozzle plate 34, a rotary portion 57 that has the wipers 60 and 61 and an elliptic shape, and a pillar 58 provided on the support base 21 to support the rotary portion 57. The two wipers 60 and 61 have the same length, and are respectively provided on a major axis and a minor axis of the rotary portion 57. The rotary portion 57 can rotate by a non-illustrated power without restraint. The rotary portion 57 has a thickness corresponding to a width of each of the wipers 60 and 61. Further, as shown in FIG. 22, a height of each of the wipers 60 and 61 can be arbitrary changed by varying a position at which the rotary portion 57 stops. It is good enough to select a major-axis radius and a minor-axis radius of the rotary portion 57 in accordance with a gap between a recording head 4 and a wiper 40.

When the rotary portion 57 rotates and the major axis of the rotary portion 57 becomes horizontal (the major axis of the rotary portion 57 becomes parallel with the nozzle plate 34), the wiper 61 is separated from the nozzle plate 34 to perform non-contact cleaning. Furthermore, as shown in FIG. 22, when the minor axis of the rotary portion 57 becomes horizontal (the short axis of the rotary portion 57 becomes parallel with the nozzle plate 34), the wiper 60 comes into contact with the nozzle plate 34 to perform contact cleaning.

As described above, the rotary portion 57 can rotate by a non-illustrated power without restraint. Therefore, a height of each of the wipers 60 and 61 according to this embodiment can be changed irrespective of positions, e.g., a wiper home position or a wiper cancel position. Accordingly, for example, when the cleaning unit 5 moves from the wiper home position to the wiper cancel position, contact cleaning can be carried out in this embodiment. When the cleaning unit 5 moves from the wiper cancel position to the wiper home position, non-contact cleaning can be performed in this embodiment. Moreover, according to this embodiment, when each of the wipers 60 and 61 of the rotary portion 57 stops at a position where it does not face the recording head, cleaning can be avoided.

Additionally, according to this embodiment, the wiper 60 can be directly fixed on the rotary portion 57, and one of contact cleaning and non-contact cleaning can be selected and switched based on rotation of the rotary portion 57. Therefore, spaces of the gap adjustment mechanism 11 and the wiping portion 22 can be reduced.

Timings of basic recording and cleaning according to this embodiment are the same as those according to the first embodiment.

According to this embodiment, the rotary portion 57 is rotated to select the wiper 60 or 61, thereby performing contact cleaning or non-contact cleaning. In this embodiment, combining contact cleaning with non-contact cleaning allows cleaning the nozzle plate for a long time without provoking clogging and without abrading an ink-repellant coating. Therefore, according to this embodiment, an ink can be stably ejected, and a high-quality image can be recorded.

In this embodiment, the two wipers 60 and 61 are arranged on the rotary portion 57. However, the present invention does not have to be restricted to this shape. For example, three wipers may be arranged on the rotary portion 57. As a result, gaps between the respective wipers and the nozzle plate are different from each other, and hence conditions when performing cleaning can be set in detail. In this manner, the number of wipers does not have to be restricted.

Further, when the rotary portion 57 has, e.g., a perfect circular shape, the wiper 60 has a length with which the wiper 60 comes into contact with the nozzle plate 34, and the wiper 61 has a length with which the wiper 61 does not come into contact with the nozzle plate 34, for example. When one of the wipers 60 and 61 has the length that allows contact with the nozzle plate 34 and the other has the length that does not allow contact with the nozzle plate in this manner, the same effect as that of this embodiment can be obtained.

A fifth embodiment will now be described in detail with reference to FIGS. 23, 24, 25, 26 and FIGS. 27A and 27B.

A cleaning unit 5 according to this embodiment has a structure different from those of the cleaning units a according to the first to the fourth embodiments. Other structures than the cleaning unit 5 according to this embodiment are the same as those according to the first embodiment, thereby omitting a detailed explanation thereof. Furthermore, like reference numerals denote parts equal to those in the first embodiment, thereby omitting a detailed explanation thereof.

Figure 23:
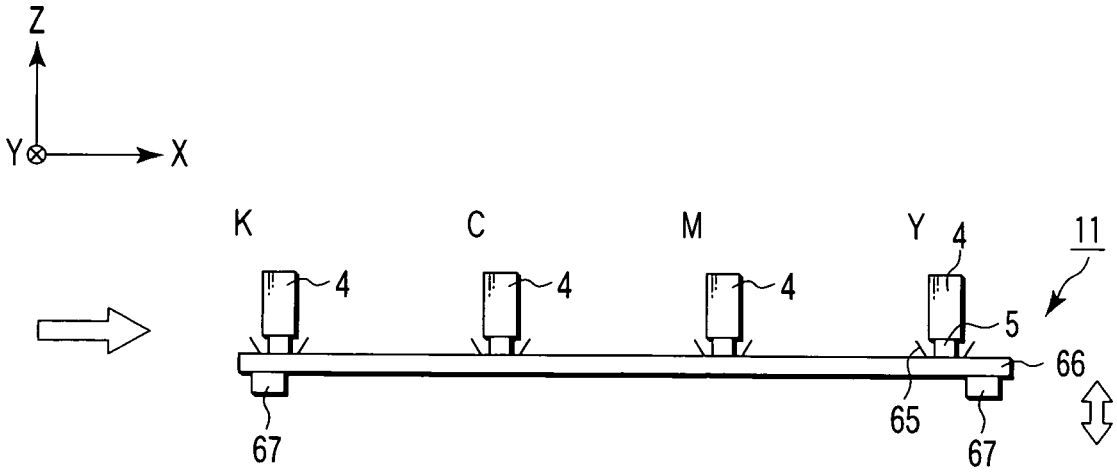
FIG. 23 is a side view showing a recording head and a cleaning unit in a fifth embodiment according to the present invention.
Figure 24:
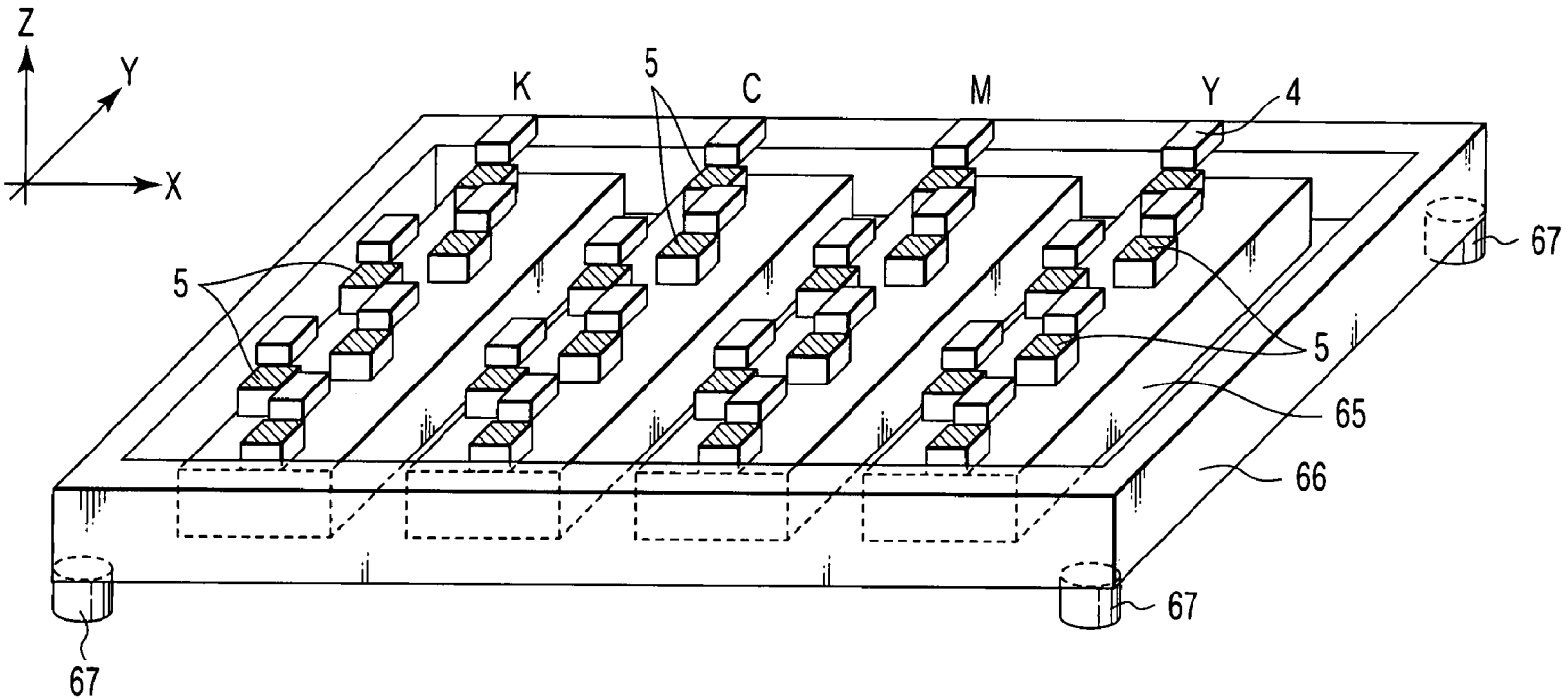
FIG. 24 is a schematic perspective view showing a recording head, a cleaning unit, a frame, and a height adjustment member.
Figure 25A:
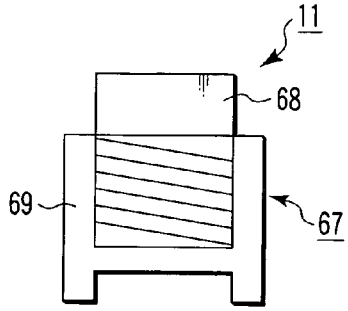
FIG. 25A is a view showing the height adjustment member.
Figure 25B:
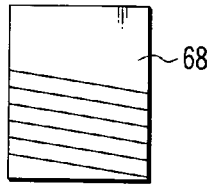
FIG. 25B is a view showing the height adjustment member.
Figure 25C:
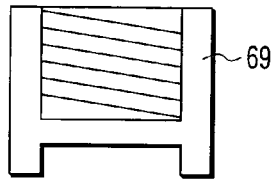
FIG. 25C is a view showing the height adjustment member.
Figure 26:
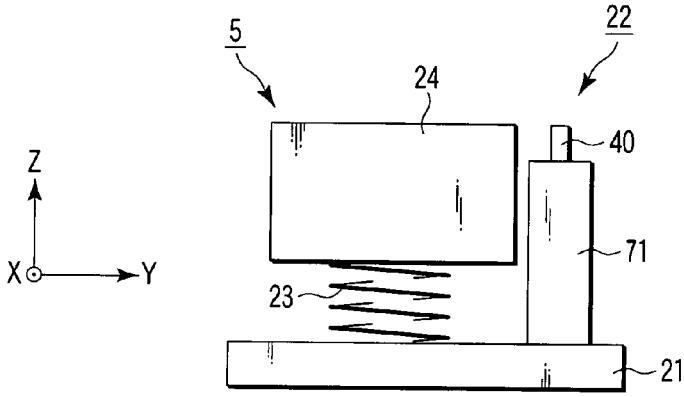
FIG. 26 is a side view showing the cleaning unit.
Figure 27A:
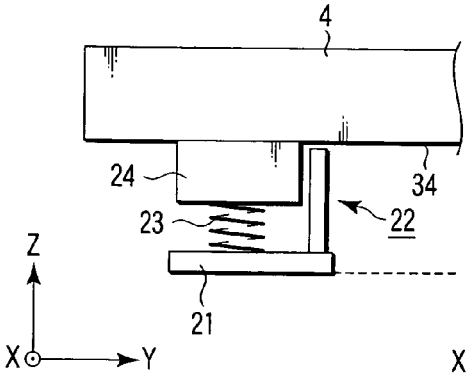
FIG. 27A is a side view of the cleaning unit that is not in contact with the recording head.
Figure 27B:
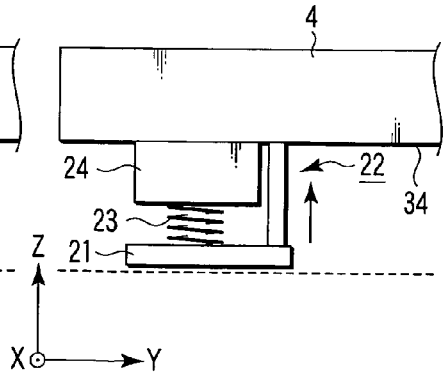
FIG. 27B is a side view of the cleaning unit that is in contact with the recording head.

FIG. 23 is a side view showing recording heads 4 and cleaning units 5. FIG. 24 is a schematic perspective view showing the recording heads 4, the cleaning units 5, a frame 66, and height adjustment members 67 as gap adjustment mechanisms 11. FIGS. 25A, 25B, and 25C are views showing a height adjustment portion. FIG. 26 is a side view of the cleaning unit 5. FIG. 27A is a side view of the cleaning unit 5 that is not in contact with the recording head 4, and FIG. 27B is a side view of the cleaning unit 5 that is in contact with the recording head 4.

As shown in FIGS. 23 and 24, recording heads 4 having a plurality of colors, e.g., black (K), cyan (C), magenta (M), and yellow (Y) in this example are provided to face the cleaning units 5. The cleaning units 5 corresponding to the respective colors are collectively provided in each ink pan 65 in accordance with each color. The plurality of ink pans 65 are supported by the frame 66. The height adjustment members 67 as the gap adjustment mechanisms 11 are provided at four corners of this frame 66. As shown in FIGS. 25A, 25B, and 25C, a shaft foot 68 and a rotary cap 69 are provided in the height adjustment member 67. Threading is provided to each of the shaft foot 68 and the rotary cap 69, and the rotary cap 69 rotates by a non-illustrated power. A height of this height adjustment member 67 can cab be changed on multiple stages based on a rotation angle of the rotary cap 69. Furthermore, a carriage mechanism for a non-illustrated recording medium 2 whose height and parallelism are determined is provided bellow the height adjustment members 67. When the height adjustment members 67 are provided above the carriage mechanism, a position of the frame 66 is determined.

On the other hand, as shown in FIG. 26, in the cleaning unit 5 are provided a support base 21 that faces nozzles 3 and can move in a traveling direction along which a cleaning operation is performed, a wiping portion 22 that is provided on the support base 21, can adjust movement in a Z axis direction, and cleans a nozzle plate 34 when the support base 21 moves, and a suction nozzle 24 that is provided behind the wiping portion 22 with respect to the traveling direction along which a cleaning operation is performed, provided on the support base 21 through a spring 23, and sucks an ink removed by the wiping portion 22. A wiper 40, and a support 71 that is provided on the support base 21 to support the wiper 40 are provided in the wiping portion 22. In this embodiment, a height position of the wiper 40 is not variable but fixed with respect to the support base 21.

In the cleaning unit 5, when the shaft foot 68 with respect to the rotary cap 69 in each of the four height adjustment members 67 is moved down, the wiper 40 enters a non-contact state with respect to the nozzle plate 34 of the recording head 4 as shown in FIG. 27A. When the shaft foot 68 with respect to the rotary cap 69 in each of the four height adjustment members 67 is moved up, the wiper 40 enters a contact state with respect to the recording head 4 as shown in FIG. 27B.

A height of the wiper 40 is adjusted at the wiper home position where the cleaning unit 5 is retracted like the first embodiment (see FIG. 2). The wiper 40 performs cleaning below the recording head 4, i.e., at a position opposed to the nozzle plate 34 (a cleaning range). Adjustment to restore the wiper 40 to its original height (separate the wiper 40 from the nozzle plate 34) is performed at a wiper cancel position as an end edge of an operating range of the cleaning unit 5.

Timings of basic recording and cleaning according to this embodiment are the same as those according to the first embodiment.

In this embodiment, the height of the wiper 40 can be adjusted by the single frame 66 in which all the wipe blades 40 are arranged, and hence a mechanism is simple as compared with an example in which the height is changed in accordance with each wipe blade 40. Moreover, according to this embodiment, since the height can be adjusted on multiple stages, the height can be set on three or more stages in accordance with, e.g., a magnitude of cleaning or a type of an ink.

According to this embodiment, the height can be adjusted at a time by using the frame 66. Therefore, in this embodiment, contact cleaning and non-contact cleaning can be easily selected. According to this embodiment, combining contact cleaning with non-contact cleaning allows cleaning the nozzle plate for a long time without provoking clogging and without abrading an ink-repellant coating. Thus, according to this embodiment, an ink can be stably ejected, and a high-quality image can be recorded.

A sixth embodiment will now be described with reference to FIGS. 28 to 33.

In this embodiment, like reference numerals denote parts equal to those in the first embodiment, thereby omitting a detailed explanation thereof.

Figure 28:
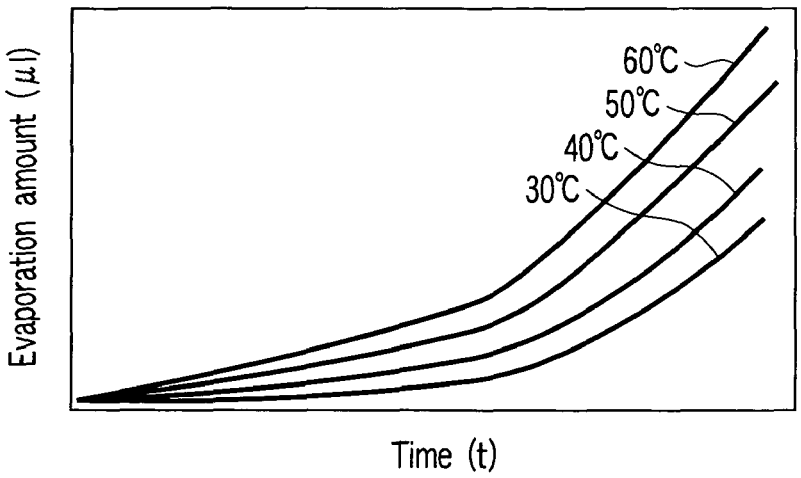
FIG. 28 is a view showing a relationship between a leaving time (t) at each ambient temperature and an evaporation amount (μl) of the ink according to a sixth embodiment.
Figure 29:
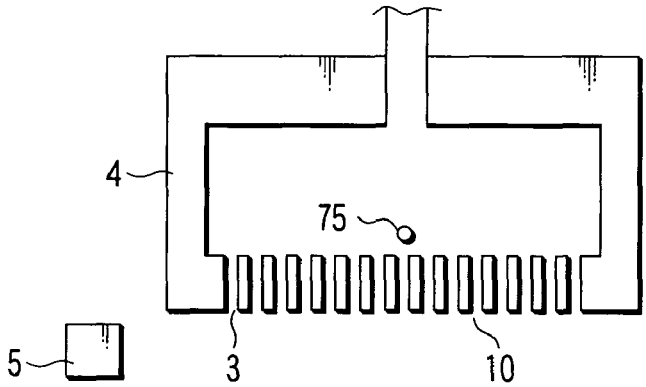
FIG. 29 is a schematic side view of a periphery of a recording head.
Figure 30:
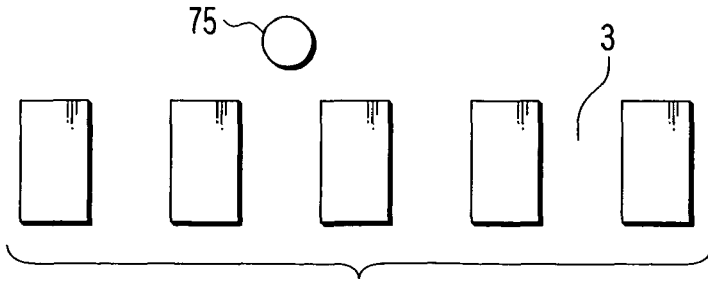
FIG. 30 is an enlarged view of a periphery of a nozzle.
Figure 31:
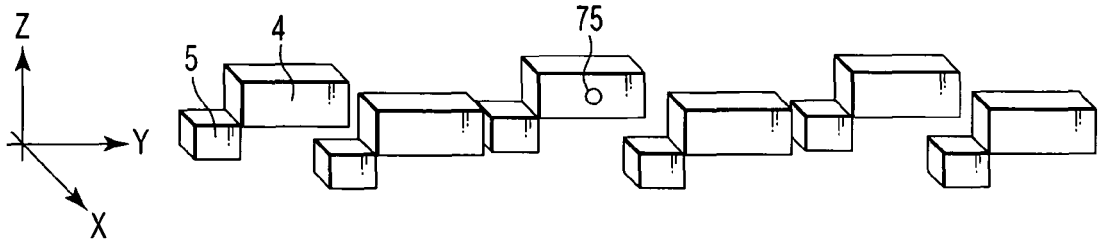
FIG. 31 is a schematic view showing a state where a plurality of recording heads are provided.
Figure 32:
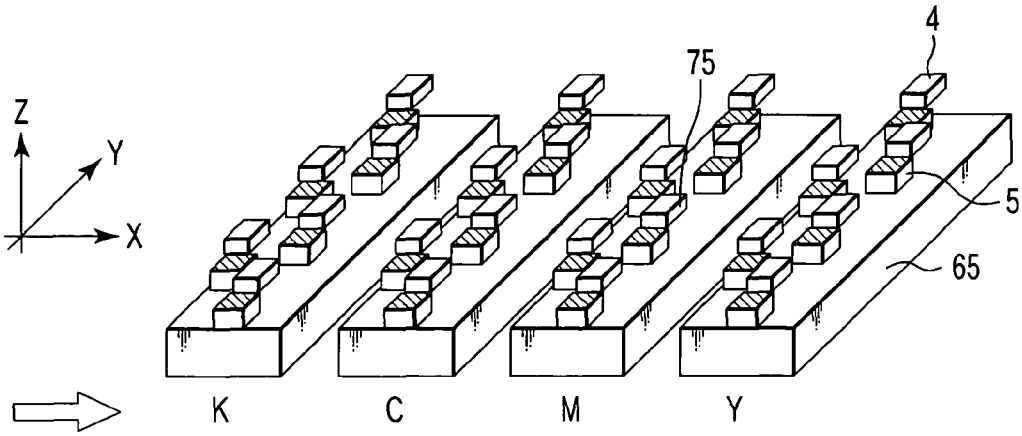
FIG. 32 is a view showing recording heads arranged in accordance with respective colors.
Figure 33:
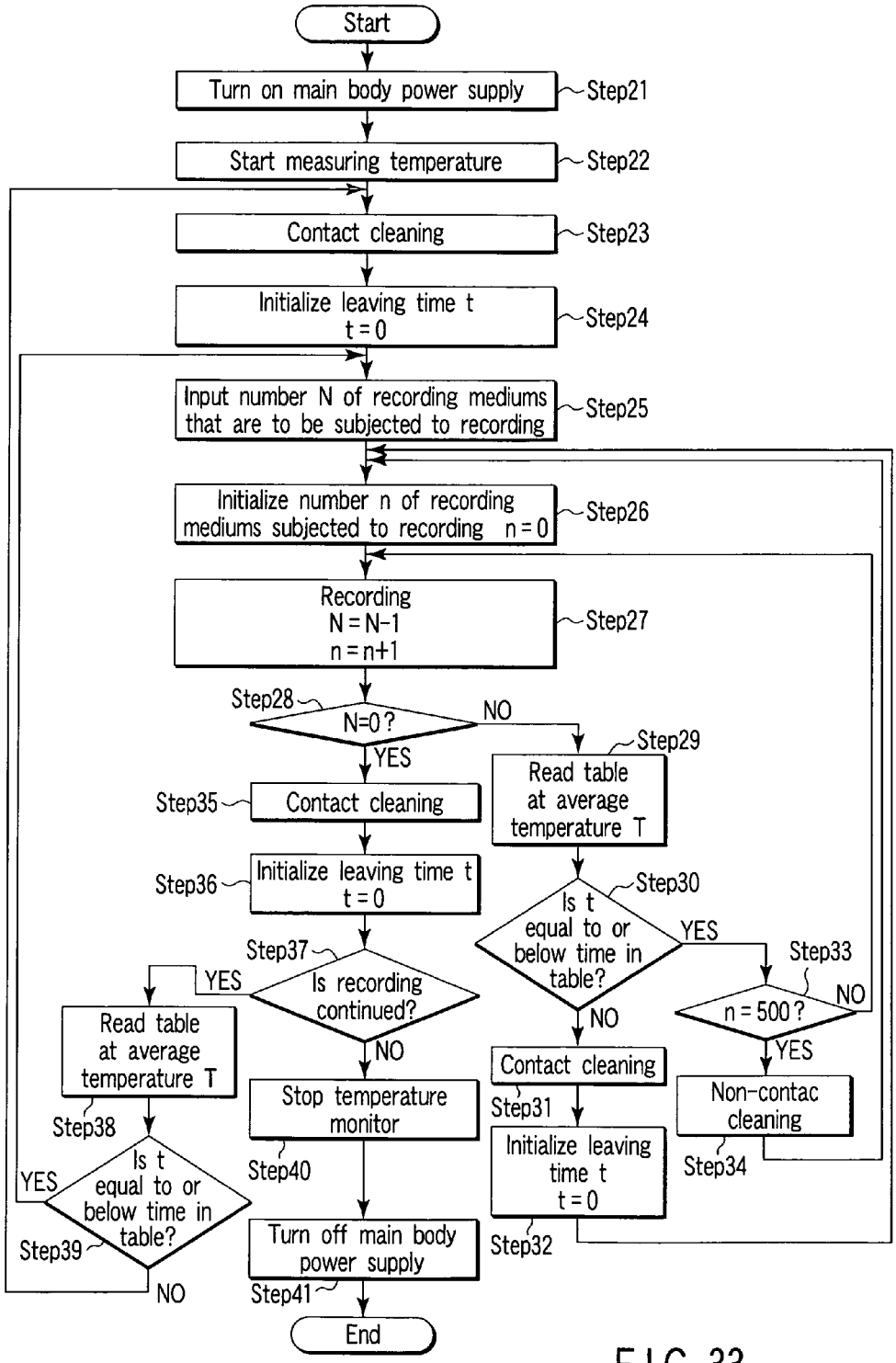
FIG. 33 is a flowchart showing timings of recording and cleaning.

FIG. 28 is a view showing a relationship between a time (t) of leaving an ink at each different ambient temperature and an evaporation amount (μl) of the ink. FIG. 29 is a schematic side view of a periphery of a recording head 4. FIG. 30 is an enlarged view of a periphery of nozzles 3. FIG. 31 is a schematic view showing that the plurality of recording heads 4 are provided. FIG. 32 is a view showing that the recording heads 4 are arranged in accordance with respective colors (black (K), cyan (C), magenta (M), and yellow (Y)). FIG. 33 is a flowchart showing timings of recording and cleaning.

Drying and solidification of an ink depend on an evaporation amount of the ink. As shown in FIG. 28, the evaporation amount (μl) differs based on an ambient temperature (T). Further, conditions of drying, thickening, and solidification of the ink slightly remaining on a nozzle plate 34 vary depending on an ambient temperature and a leaving time. When contact cleaning is carried out at the same timing in a single uniform way at different ambient temperatures, contact cleaning may be performed beyond necessity depending on conditions.

Thus, an inkjet recording apparatus 1 according to this embodiment has each ambient temperature and an upper limit time in which the ink is not dried, thickened, and solidified at each ambient temperature as a table. The inkjet recording apparatus 1 makes reference to this table between respective recording operations to avoid contact cleaning beyond necessity. Drying, thickening, and solidification of the ink occur on the nozzle plate 34. Therefore, an ambient temperature is determined as a temperature in the vicinity of each nozzle 3 in each recording head 4. As a result, an interval between cleaning operations can be more efficiently controlled.

It is to be noted that a value of an ambient temperature and a value of a temperature in the table according to this embodiment vary depending on a type of the ink (e.g., an aqueous type, a solvent, or an oil-based type), and hence obtaining an optimum value for each ink can suffice.

A temperature gauge 75 as a measurement portion measures an ambient temperature outside each recording head 4. As shown in FIGS. 29 and 30, the temperature gauge 75 is provided in the vicinity of the center of a nozzle string 10 in the recording head 4. As shown in FIG. 31, when the plurality of recording heads 4 are arranged, the temperature gauge 75 is arranged in the vicinity of the center of the nozzle string 10 of the recording head placed in the vicinity of the center in a Y axis direction. Furthermore, as shown in FIG. 32, when the inkjet recording apparatus 1 has the plurality of recording heads 4 that are arranged on a line in accordance with each color, the temperature gauge 75 is arranged in the vicinity of the center of the nozzle string 10 in the recording head 4 placed in the vicinity of the center in an X axis direction and in the vicinity of the center in the Y axis direction.

Incidentally, in regard to a temperature to be measured, it is preferable to measure a temperature on the surface of the nozzle plate 34 or a temperature at a point placed in the vicinity of the surface of the nozzle plate 34. Therefore, according to this embodiment, a sensor portion of the temperature gauge may be provided on the surface of the nozzle plate 34, or the sensor portion of the temperature gauge may be provided on a mask plate 33.

Timings of recording and cleaning will now be explained with reference to FIG. 33.

When a power supply of the inkjet recording apparatus 1 is turned on (a Step 21), the inkjet recording apparatus 1 starts measurement by using the temperature gauge 75 provided in the recording head 4 (a Step 22). Then, the inkjet recording apparatus 1 carries out contact cleaning (a Step 23). Further, the inkjet recording apparatus 1 initializes the leaving time t to zero in order to start timer measurement (a Step 24). Subsequently, an operator inputs the number N of recording mediums on which images are to be recorded (a Step 25). Then, the inkjet recording apparatus 1 initializes the number n of recording mediums that has already been recorded to zero as a counter (a Step 26). Furthermore, the inkjet recording apparatus 1 increments the number n of recording mediums that has been recorded by one every time recording is carried out, and also decrements the number N of recording mediums on which images are to be recorded by one (a Step 27).

Subsequently, the inkjet recording apparatus 1 judges whether the number N of recording mediums on which images are to be recorded is zero (a Step 28).

If the number N of recording mediums on which images are to be recorded is not zero (the Step 28: NO), the inkjet recording apparatus 1 reads the table at an average temperature T (a Step 29). This average temperature T is an average temperature from the leaving time t=0 to now. The inkjet recording apparatus 1 compares a time in the table corresponding to the average temperature T with a value of the timer (the leaving time (t)). Then, the inkjet recording apparatus 1 judges whether the value of the timer is equal to or below a time in table (a Step 30).

If the value of the timer is not equal to or below the time in table (the Step 30: NO), the inkjet recording apparatus 1 carries out contact cleaning (a Step 31). Moreover, the inkjet recording apparatus 1 initializes the leaving time t to zero in order to reset the timer (a Step 32). Subsequently, the control returns to the Step 26.

If the value of the timer is equal to or above the time in table (the Step 30: YES), the inkjet recording apparatus 1 judges whether the number n of the recording mediums that has been recorded is 500 (a Step 33).

If the number n of the recording mediums that has been recorded is 500 (the Step 33: YES), the inkjet recording apparatus 1 performs non-contact cleaning (a Step 34), and the control returns to the Step 26.

If the number n of the recording mediums that has been recorded is not 500 (the Step 33: NO), the control returns to the Step 27.

If the number N of the recording mediums on which images are to be recorded is zero (the Step 28: YES), the inkjet recording apparatus 1 performs contact cleaning (a Step 35). Then, the inkjet recording apparatus 1 initializes the leaving time t to zero in order to reset the timer (a Step 36), and judges whether recording is continued (a Step 37).

If recording is continued (the Step 37: YES), the inkjet recording apparatus 1 reads the table at the average temperature T (a Step 38). The inkjet recording apparatus 1 compares a time in the table corresponding to the average temperature T with a value of the timer (the leaving time (t)). Then, the inkjet recording apparatus 1 judges whether the value of the timer is equal to or below the time in the table (a Step 39).

If the value of the timer is not equal to or below the time in the table (the Step 39: NO), the control returns to the Step 23.

If the value of the timer is equal to or below the time in the table (the Step 39: YES), the control returns to the Step 25.

If recording is not continued (the Step 37: NO), the temperature monitor is stopped (a Step 40), and the power supply is turned off (a Step 41) to terminate the operation.

According to this embodiment, an ambient temperature in the vicinity of the nozzles 3 of each recording head 4 is measured by using the temperature gauge 75, and a type and a timing of cleaning are selected, thereby avoiding contact cleaning beyond necessity. Additionally, according to this embodiment, combining contact cleaning with non-contact cleaning allows cleaning the nozzle plate 34 for a long time without provoking clogging and without abrading the ink-repellant coating. Therefore, according to this embodiment, the ink can be stably ejected, and a high-quality image can be recorded.

A seventh embodiment will now be explained with reference to FIGS. 34, 35A, and 35B.

A wiping portion 22 having a gap adjustment mechanism 11 according to this embodiment has a structure different from the wiping portions 22 according to the first to the sixth embodiments. Structures other than the wiping portion 22 in this embodiment are the same as those in the first embodiment, thereby omitting a detailed explanation thereof. Further, like reference numerals denote parts equal to those in the first embodiment, thereby omitting a detailed explanation thereof.

Figure 34:
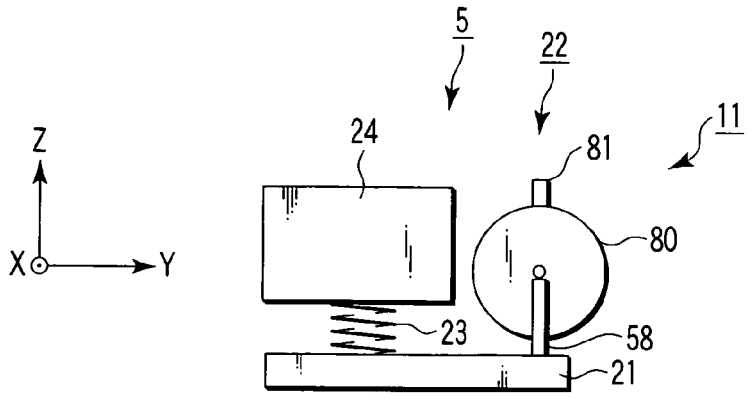
FIG. 34 is a schematic side view of a cleaning unit according to a seventh embodiment.

FIG. 34 is a schematic side view of a cleaning unit 5. FIGS. 35A and 35B are enlarged views of a periphery of a rotary member. A wiping portion 22 has a gap adjustment mechanism 11.

As shown in FIG. 34, according to this embodiment, a rotary portion 80 having a perfect circular shape is provided in place of the rotary portion 57 having an elliptic shape provided in the fourth embodiment. One wiper 81 is provided on this rotary portion 80. The rotary portion 80 has a thickness corresponding to a width of the wiper 81 like the rotary portion 57. Further, the rotary portion 80 is supported by a pillar 58 provided on a support base 21 like the rotary portion 57. Furthermore, the rotary portion 80 can rotate by a non-illustrated power without restraint like the rotary portion 57.

Figure 35A:
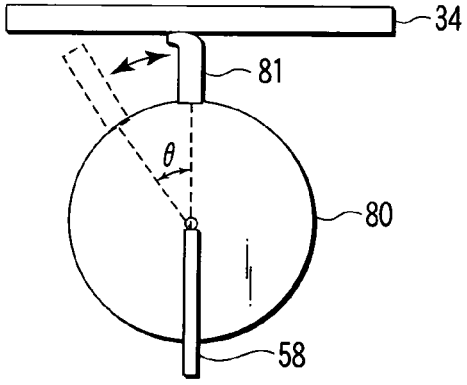
FIG. 35A is an enlarged view of a periphery of a rotary member.
Figure 35B:
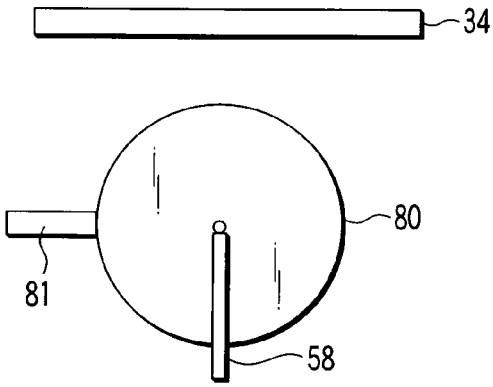
FIG. 35B is an enlarged view of the periphery of the rotary member.
Figure 36A:
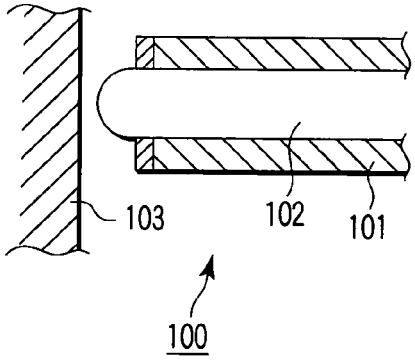
FIG. 36A shows a conventional maintenance apparatus for an inkjet printer.
Figure 36B:
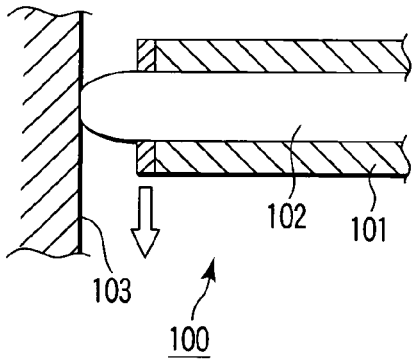
FIG. 36B shows the conventional maintenance apparatus for an inkjet printer.

As shown in FIG. 35A, the rotary portion 80 adjusts an angle θ illustrated in a vertical direction with respect to the support base 21. Adjusting the angle θ allows adjusting a relative gap between the wiper 81 and a nozzle plate 34 on multiple stages. As a result, according to this embodiment, contact cleaning or non-contact cleaning can be selected.

Timings of basic recording and cleaning are the same as those in the first embodiment.

According to this embodiment, the rotary portion 80 can rotate by a non-illustrated power without restraint to adjust the angle θ as compared with the fourth embodiment. Therefore, according to this embodiment, since the relative gap can be adjusted on multiple stages irrespective of a position of the wiper 81 on the circular rotary portion 80, contact cleaning or non-contact cleaning can be selected. Accordingly, for example, when the cleaning unit 5 moves from a wiper home position to a cleaning range, the wiper 81 comes into contact with the nozzle plate 34 (contact cleaning). When the cleaning unit 5 moves from a wiper cancel position to the cleaning range, the wiper 81 is separated from the nozzle plate 34 (non-contact cleaning). Alternatively, as shown in FIG. 35B, for example, the rotary portion 80 can rotate to move the wiper 81 in such a manner that the wiper 81 becomes parallel with the nozzle plate 34, thereby eliminating wiping.

Further, the relative gap between the wiper 81 and the nozzle plate 34 can be appropriately set based on a diameter of the rotary portion 80 and the angle θ.

According to this embodiment, combining contact cleaning with non-contact cleaning allows cleaning the nozzle plate for a long time without provoking clogging and without abrading an ink-repellant coating. Therefore, according to this embodiment, an ink can be stably ejected, and a high-quality image can be recorded.

Moreover, a plurality of wipers having different lengths may be provided on the rotary portion 80.

Additionally, the rotary portion 80 is used as a mechanism that inclines the wiper 81, but other structures, e.g., a link mechanism can be adopted.

It is to be noted that the recording head 4 is fixed and the cleaning unit 5 moves in the nozzle arrangement direction to clean the nozzle plate 34 in each of the foregoing embodiments. However, the cleaning unit 5 may be fixed, and the recording head 4 may move.

Further, in each of the foregoing embodiment, the recording head 4 is fixed, and the cleaning unit 5 moves closer to or away from the recording head 4 to change the gap between the cleaning unit 5 and the nozzle plate 34 of the recording head 4. However, the cleaning unit 5 may be fixed, and the recording head 4 may move closer to or away from the wiper.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An inkjet recording apparatus comprising:

a recording head having a nozzle plate on which a nozzle string formed of a plurality of nozzles that eject inks onto a recording medium is arranged; and a wiper that cleans a surface of the nozzle plate, wherein the wiper is operable in one of a first cleaning mode and a second cleaning mode that is selected at a time of cleaning, wherein in the first cleaning mode the wiper and the nozzle plate come into contact with each other and move relatively with respect to each other to clean dust or waste ink that has adhered to the nozzle plate, and in the second cleaning mode the wiper comes into contact with waste ink that has adhered to the nozzle plate, without coming into contact with the nozzle plate, to clean the waste ink that has adhered to the nozzle plate, and wherein the wiper relatively moves with respect to the nozzle string to perform the cleaning.

2. The inkjet recording apparatus according to claim 1, wherein the wiper tends to more easily get wet than the surface of the nozzle plate.

3. The inkjet recording apparatus according to claim 1, further comprising:

a wiping portion having the wiper; and a gap adjustment mechanism that adjusts a gap between the wiper and the nozzle plate through the wiping portion.

4. The inkjet recording apparatus according to claim 3, wherein the gap adjustment mechanism has a first adjustment member that adjusts the gap, and when the first adjustment member pushes the wiping portion, the wiper moves to adjust the gap.

5. The inkjet recording apparatus according to claim 3, wherein the gap adjustment mechanism comprises:

a second adjustment member arranged in the vicinity of the nozzle plate; and an elastic member that faces the second adjustment member and is provided in the wiping portion, wherein the wiping portion pushed by the second adjustment member is urged in a direction of the nozzle plate by the elastic member to adjust the gap.

6. The inkjet recording apparatus according to claim 3, wherein the gap adjustment mechanism adjusts the gap on multiple stages.

7. The inkjet recording apparatus according to claim 3, wherein, when the wiper cleans the surface of the nozzle plate, the gap adjustment mechanism selects one of the first cleaning mode and the second cleaning mode to adjust the gap.

8. The inkjet recording apparatus according to claim 3, wherein the gap adjustment mechanism comprises a changing member that changes the first cleaning mode to the second cleaning mode.

9. The inkjet recording apparatus according to claim 3, wherein the gap adjustment mechanism has a rotary portion that moves the wiper.

10. The inkjet recording apparatus according to claim 9, wherein the rotary portion has an elliptic portion that rotates, and the wiper moves to adjust the gap when the elliptic portion rotates.

11. The inkjet recording apparatus according to claim 9, wherein:

the rotary portion has an elliptic portion that rotates, a plurality of wipers are provided on the elliptic portion, and one of the plurality of wipers is selectively moved to adjust the gap when the elliptic portion rotates.

12. The inkjet recording apparatus according to claim 9, wherein the rotary portion has a circular portion that rotates, the circular portion is provided with at least one wiper, and when the circular portion rotates, the at least one wiper is selectively moved to adjust the gap.

13. The inkjet recording apparatus according to claim 1, wherein the wiper relatively moves in an arrangement direction of the nozzle string to clean the surface of the nozzle plate in the first cleaning mode and the second cleaning mode.

14. The inkjet recording apparatus according to claim 1, further comprising:

a measurement portion that measures a temperature in a vicinity of the nozzle plate, wherein one of the first cleaning mode and the second cleaning mode is selected in accordance with the temperature measured by the measurement portion.

15. The inkjet recording apparatus according to claim 1, wherein one of the first cleaning mode and the second cleaning mode is selected in accordance with a number of recording mediums that have been recorded.

16. The inkjet recording apparatus according to claim 1, wherein one of the first cleaning mode and the second cleaning mode is selected in accordance with a non-recording time in which the recording head does not eject the ink.

17. The inkjet recording apparatus according to claim 1, wherein one of the first cleaning mode and the second cleaning mode is selected in accordance with at least one of a non-recording time in which the recording head does not eject the ink, a number of recording mediums that have been recorded, and a temperature in a vicinity of the nozzle plate.

* * * * *